US009713753B2

(12) United States Patent
Nakamura

(10) Patent No.: US 9,713,753 B2
(45) Date of Patent: Jul. 25, 2017

(54) GOLF CLUB SHAFT

(71) Applicant: DUNLOP SPORTS CO. LTD., Kobe-shi, Hyogo (JP)

(72) Inventor: Hirotaka Nakamura, Kobe (JP)

(73) Assignee: DUNLOP SPORTS CO. LTD., Kobe-Shi, Hyogo (JP)

( * ) Notice: Subject to any disclaimer, the term of this patent is extended or adjusted under 35 U.S.C. 154(b) by 0 days.

(21) Appl. No.: 14/955,695

(22) Filed: Dec. 1, 2015

(65) Prior Publication Data

US 2016/0184671 A1 Jun. 30, 2016

(30) Foreign Application Priority Data

Dec. 26, 2014 (JP) ..... 2014-264618

(51) Int. Cl.
*A63B 53/10* (2015.01)
*A63B 60/42* (2015.01)
*A63B 53/12* (2015.01)

(52) U.S. Cl.
CPC ..... *A63B 53/10* (2013.01); *A63B 60/42* (2015.10); *A63B 53/12* (2013.01); *A63B 2209/02* (2013.01); *A63B 2209/023* (2013.01); *A63B 2209/026* (2013.01)

(58) Field of Classification Search
CPC ..... A63B 53/10; A63B 53/12; A63B 2209/02; A63B 2209/023; A63B 2209/026
USPC ..... 473/319, 320, 321, 316
See application file for complete search history.

(56) References Cited

U.S. PATENT DOCUMENTS

2009/0029792 A1 1/2009 Kumamoto
2010/0317456 A1* 12/2010 Kato ..... A63B 53/10 473/319

FOREIGN PATENT DOCUMENTS

JP 11-019257 A 1/1999

* cited by examiner

*Primary Examiner* — Benjamin Layno
(74) *Attorney, Agent, or Firm* — Birch, Stewart, Kolasch & Birch, LLP

(57) ABSTRACT

A shaft 6 includes at least two hoop layers s3 and s8, at least one bias layer, and at least one straight layer. An interposition layer other than the hoop layer is present between every opposing hoop layers. An average thickness of the opposing hoop layers is defined as t, and a total thickness of the interposition layer is defined as T. The shaft 6 satisfies the following formula (1):

$$T/t \geq 1.9 \quad (1).$$

8 Claims, 8 Drawing Sheets

GOLF CLUB SHAFT

The present application claims priority on Patent Application No. 2014-264618 filed in JAPAN on Dec. 26, 2014, the entire contents of which are hereby incorporated by reference.

BACKGROUND OF THE INVENTION

Field of the Invention

The present invention relates to a golf club shaft.

Description of the Related Art

A so-called carbon shaft has been known as a golf club shaft. A sheetwinding method has been known as a method for manufacturing the carbon shaft.

A prepreg includes a matrix resin and a fiber. Many types of prepregs exist. A variety of prepregs having different resin contents have been known. A variety of prepregs having different fibers have been known. In the present application, the prepreg is also referred to as a prepreg sheet or a sheet.

In the sheetwinding method, the type, shape, and disposal of a sheet, and the orientation of a fiber can be selected. The type of the prepreg can also be selected. A sheet constitution is designed corresponding to desired characteristics of a shaft.

A shaft including a plurality of hoop layers has been known. Japanese Patent application Laid-Open No. 11-19257 discloses a constitution in which three or four hoop layers are present in at least a part of a shaft. Japanese Patent Application Laid-Open No. 2009-22622 (US2009/0029792) discloses a shaft including a full length hoop layer and a partial reinforcing hoop layer.

SUMMARY OF THE INVENTION

The present inventors have found that the novel disposal of a plurality of hoop layers can increase strength.

It is an object of the present invention to provide a lightweight golf club shaft having excellent strength.

A preferable shaft includes: at least two hoop layers; at least one bias layer; and at least one straight layer. An interposition layer other than the hoop layer is present between every opposing hoop layers. If an average thickness of the opposing hoop layers is defined as t and a total thickness of the interposition layer is defined as T, the shaft satisfies the following formula (1):

$$T/t \geq 1.9 \quad (1).$$

Preferably, the hoop layer located on an outermost side in a radial direction has a thickness of 0.050 mm or greater and 0.090 mm or less.

If the total number of plies of the interposition layer is defined as P, the shaft preferably satisfies the following formula (2):

$$P/t \geq 30 \quad (2).$$

Preferably, the shaft satisfies the following formula (3):

$$T/t \geq 2.2 \quad (3).$$

Preferably, the shaft satisfies the following formula (4):

$$T/t \geq 2.5 \quad (4).$$

Preferably, the number of the straight layers is equal to or greater than 2. Preferably, the number of the bias layers is equal to or greater than 2. Preferably, a laminated portion X in which any one of the hoop layers is sandwiched between the two bias layers is present in at least a partial range in an axis direction of the shaft. Preferably, a laminated portion Y in which any one of the hoop layers is sandwiched between the two straight layers is present in at least a partial range in an axis direction of the shaft.

Preferably, the laminated portion X is located on an inner side with respect to the laminated portion Y in a range in which both the laminated portion X and the laminated portion Y are present.

Preferably, the hoop layer in the laminated portion Y has a thickness of 0.050 mm or greater and 0.090 mm or less.

Preferably, at least a part of the laminated portion Y constitutes an outermost layer of the shaft. Preferably, at least apart of the laminated portion X constitutes an innermost layer of the shaft.

A golf club shaft having excellent strength can be obtained.

DESCRIPTION OF THE PREFERRED EMBODIMENTS

The present invention will be described later in detail based on preferred embodiments with appropriate reference to the drawings.

In the present application, an "axial direction" means an axial direction of a shaft. In the present application, a "radial direction" means a radial direction of the shaft. In the present application, a "range" means a range in the axis direction.

Figure 1:
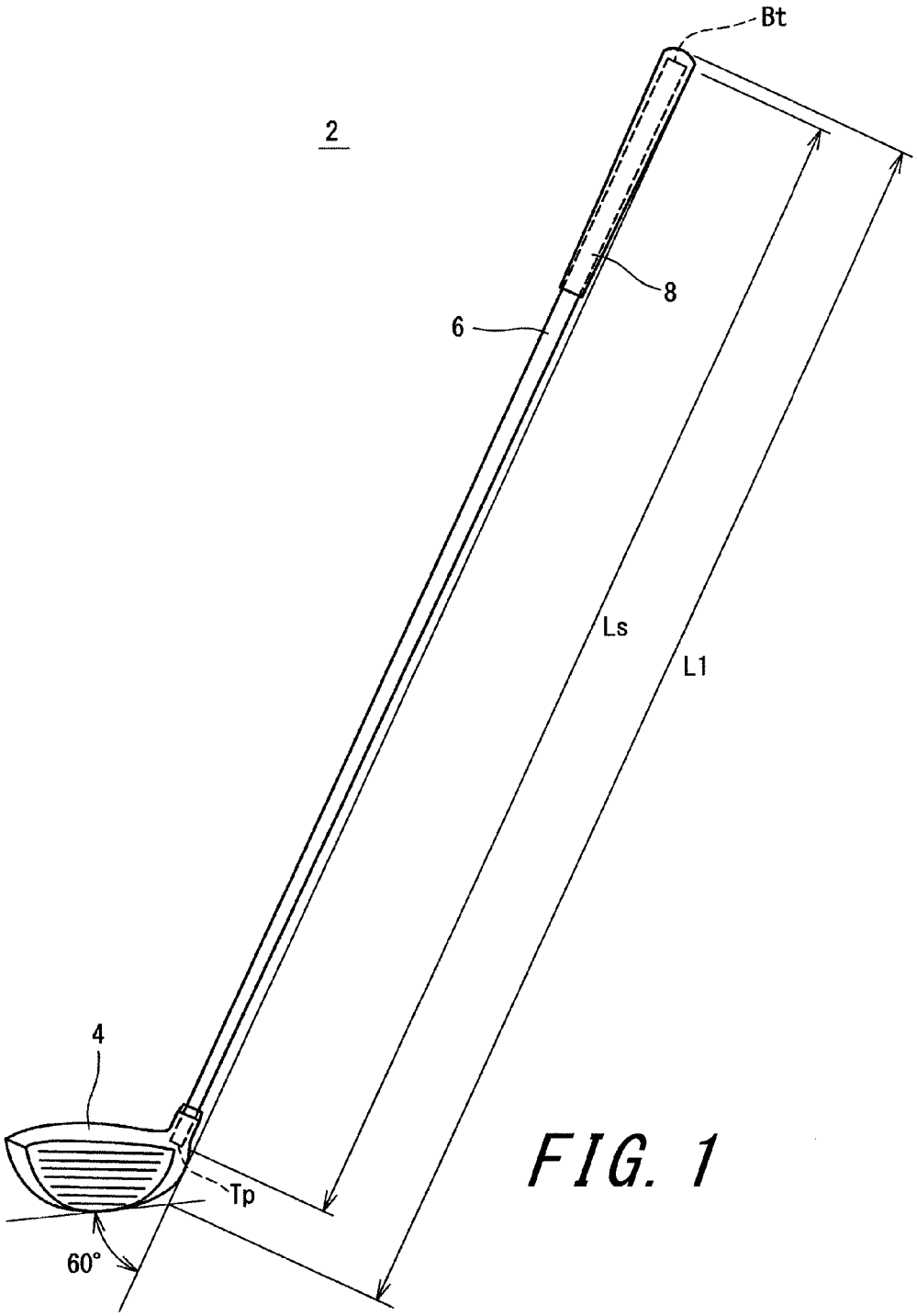
FIG. 1 shows a golf club including a shaft according to a first embodiment.

As shown in FIG. 1, a golf club 2 includes a head 4, a shaft 6, and a grip 8. The head 4 is attached to a tip portion of the shaft 6. The grip 8 is attached to a butt portion of the shaft 6. The head 4 has a hollow structure. The head 4 is a wood type head. The golf club 2 is a driver (1-wood).

From the viewpoint of a flight distance, a club length L1 is preferably equal to or greater than 43 inches, more preferably equal to or greater than 44 inches, and still more preferably equal to or greater than 45 inches. From the viewpoint of easiness of swing, the club length L1 is preferably equal to or less than 48 inches, and more preferably equal to or less than 47 inches. In respect of the flight distance, a preferable head 4 is a wood type golf club head. Preferably, the golf club 2 is a wood type golf club.

The club length is shown by a double-pointed arrow L1 in FIG. 1. The club length L1 is measured based on "1c Length" in "1 Clubs" of "Appendix II Design of Clubs" in the Golf Rules defined by R&A (Royal and Ancient Golf club of Saint Andrews). The length L1 is measured in a state where a club is placed on a horizontal plane and a sole is set against a plane of which an angle with respect to the horizontal plane is 60 degrees. The method for measuring the club length is referred to as a 60-degrees method.

A shaft length is shown by a double-pointed arrow Ls in FIG. 1. The shaft length Ls is a distance between a tip end Tp and a butt end Bt. The distance is measured along the axis direction.

The shaft 6 includes a laminate of fiber reinforced resin layers. The shaft 6 is a tubular body. As shown in FIG. 1, the shaft 6 has a tip end Tp and a butt end Bt. The tip end Tp is located in the head 4. The butt end Bt is located in the grip 8.

The tip part of the shaft 6 is inserted into a hosel hole of the head 4. The axial direction length of a portion of the shaft 6 inserted into the hosel hole is usually 25 mm or greater and 70 mm or less.

The shaft 6 is a so-called carbon shaft. Preferably, the shaft 6 is formed by curing a prepreg sheet. In a typical prepreg sheet, fibers are oriented substantially in one direction. The prepreg is also referred to as a UD prepreg. The term "UD" stands for uni-direction. Prepregs which are not the UD prepreg may be used. For example, fibers contained in the prepreg sheet may be woven.

The prepreg sheet has a fiber and a resin. The resin is also referred to as a matrix resin. Typically, the fiber is a carbon fiber. Typically, the matrix resin is a thermosetting resin.

The shaft 6 is manufactured by a so-called sheetwinding method. In the prepreg, the matrix resin is in a semicured state. The shaft 6 is obtained by winding and curing the prepreg sheet.

The matrix resin may be a thermosetting resin, or may be a thermoplastic resin. Typical examples of the matrix resin include an epoxy resin. From the viewpoint of shaft strength, the matrix resin is preferably an epoxy resin.

Examples of the fiber include a carbon fiber, a glass fiber, an aramid fiber, a boron fiber, an alumina fiber, and a silicon carbide fiber. Two or more of the fibers may be used in combination. From the viewpoint of the shaft strength, the fiber is preferably the carbon fiber and the glass fiber, and more preferably the carbon fiber. Particularly, the glass fiber may also be preferably used for a tip partial layer which is not an outermost layer.

Figure 2:
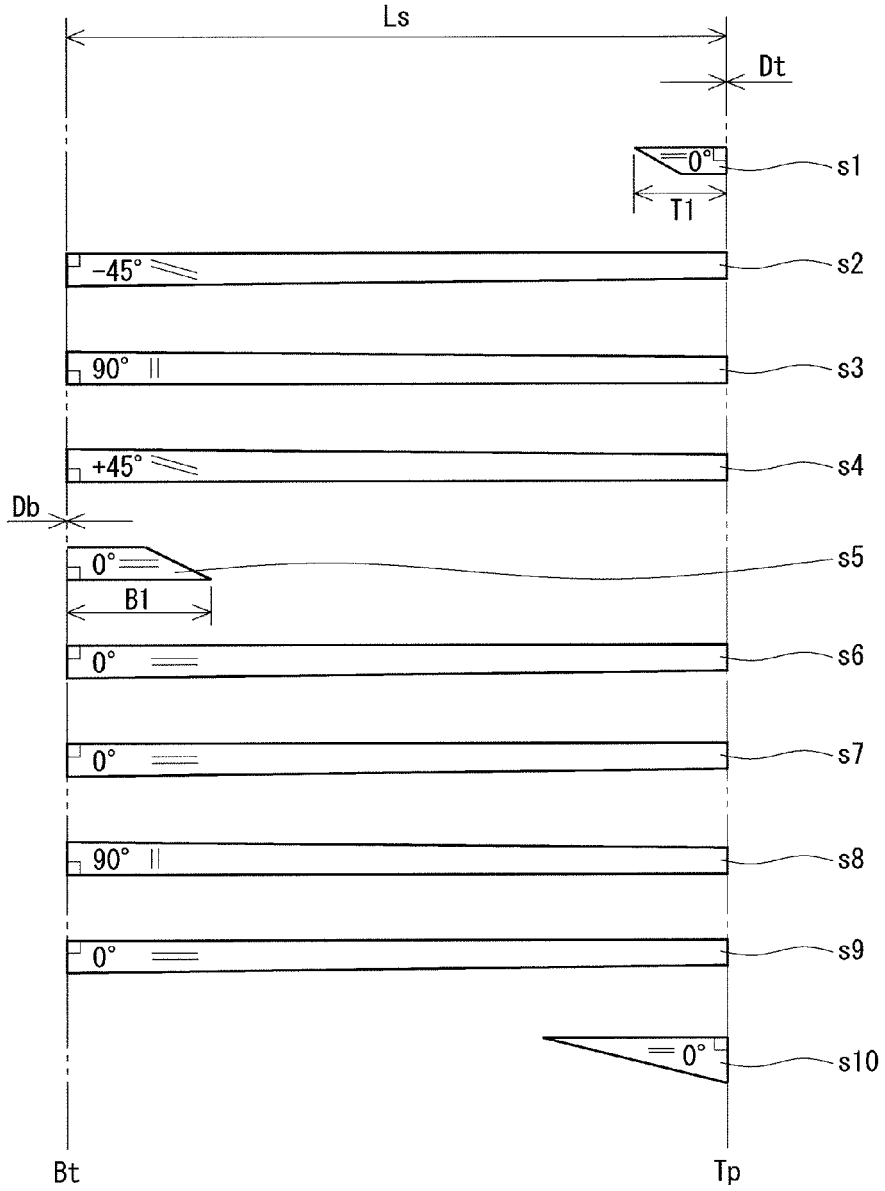
FIG. 2 is a developed view of the shaft of the first embodiment, and a laminated constitution of the first embodiment is a laminated constitution A.

FIG. 2 is a developed view (laminated constitution view) of a prepreg sheet constituting the shaft 6. The laminated constitution is also referred to as a laminated constitution A in order to distinguish the laminated constitution from other laminated constitutions.

The shaft 6 includes a plurality of sheets. The shaft 6 includes ten sheets of a first sheet s1 to a tenth sheet s10. The developed view shows the sheets constituting the shaft in order from the radial inside of the shaft. The sheets are wound in order from the sheet located on the uppermost side in the developed view. In the developed view, the horizontal direction of the figure coincides with the axis direction of the shaft. In the developed view, the right side of the figure is the tip end Tp side of the shaft. In the developed view, the left side of the figure is the butt end Bt side of the shaft.

The developed view shows not only the winding order of the sheets but also the disposal of each of the sheets in the axial direction of the shaft. For example, in FIG. 2, ends of the first sheet s1 and 10th sheet s10 are located at the tip end Tp. For example, in FIG. 2, an end of the fifth sheet s5 is located at the butt end Bt.

The term "layer" and the term "sheet" are used in the present application. The "layer" is termed after being wound. Meanwhile, the "sheet" is termed before being wound. The "layer" is formed by winding the "sheet". That is, the wound "sheet" forms the "layer". In the present application, the same symbol is used in the layer and the sheet. For example, a layer formed by a sheet s1 is a layer s1.

The shaft 6 includes a straight layer, a bias layer, and a hoop layer. An orientation angle Af of the fiber is described for each of the sheets in the developed view of the present application. The orientation angle Af is an angle to the axial direction the shaft.

The shaft 6 includes two or more bias layers. The shaft 6 includes two or more straight layers.

A sheet described as "0 degree" constitutes the straight layer. The sheet constituting the straight layer is also referred to as a straight sheet.

The straight layer is a layer in which the angle Af is substantially set to 0 degree. Usually, the angle Af is not completely set to 0 degree by error or the like in winding.

Usually, in the straight layer, an absolute angle θa is equal to or less than 10 degrees. The absolute angle θa is an absolute value of the orientation angle Af. For example, "the absolute angle θa is equal to or less than 10 degrees" means that "the angle Af is −10 degrees or greater and +10 degrees or less".

In the embodiment of FIG. 2, the straight sheets are the sheet s1, the sheet s5, the sheet s6, the sheet s7, the sheet s9, and the sheet s10.

The bias layer is highly correlated with the torsional rigidity and torsional strength of the shaft. Preferably, a bias sheet includes two sheets in which orientation angles of fibers are inclined in opposite directions to each other. In respect of the torsional rigidity, the absolute angle θa of the bias layer is preferably equal to or greater than 15 degrees, more preferably equal to or greater than 25 degrees, and still more preferably equal to or greater than 40 degrees. In respects of the torsional rigidity and flexural rigidity, the absolute angle θa of the bias layer is preferably equal to or less than 60 degrees, and more preferably equal to or less than 50 degrees.

In the shaft 6, the sheets constituting the bias layer are the second sheet s2 and the fourth sheet s4. The sheet s2 is also referred to as a first bias sheet. The sheet s4 is also referred to as a second bias sheet. As described above, in FIG. 2, the angle Af is described in each sheet. The plus (+) and minus (−) in the angle Af show that the fibers of bias sheets are inclined in opposite directions to each other. In the present application, the sheet constituting the bias layer is also merely referred to as the bias sheet. The sheet s2 and the sheet s4 constitute a united sheet to be described later.

In FIG. 2, the inclination direction of the fiber of the sheet s4 is equal to the inclination direction of the fiber of the sheet s2. However, as described later, the sheet s4 is reversed, and applied on the sheet s2. As a result, the direction of the angle Af of the sheet s2 and the direction of the angle Af of the sheet s4 are opposite to each other. In light of this point, in the embodiment of FIG. 2, the angle Af of the sheet s2 is described as −45 degrees and the angle Af of the sheet s4 is described as +45 degrees. It should be appreciated that the sheet s2 may be +45 degrees and the sheet s4 may be −45 degrees.

The shaft 6 has a plurality of hoop layers. The shaft 6 includes two hoop layers. In the shaft 6, the hoop layers are the layer s3 and the layer s8. In the shaft 6, the sheets constituting the hoop layer are the third sheet s3 and the eighth sheet s8. In the present application, the sheet constituting the hoop layer is also referred to as a hoop sheet.

Preferably, the absolute angle θa in the hoop layer is substantially 90 degrees to the axis line of the shaft. However, the orientation direction of the fiber to the axial direction of the shaft may not be completely set to 90 degrees due to an error or the like in winding. In the hoop layer, the angle Af is usually −90 degrees or greater and −80 degrees or less, or 80 degrees or greater and 90 degrees or less. In other words, in the hoop layer, the absolute angle θa is usually 80 degrees or greater and 90 degrees or less.

The number of the layers to be formed from one sheet is not limited. For example, if the number of plies of the sheet is 1, the sheet is wound by one round in a circumferential direction. If the number of plies of the sheet is 1, the sheet forms one layer at all positions in the circumferential direction of the shaft.

For example, if the number of plies of the sheet is 2, the sheet is wound by two rounds in the circumferential direction. If the number of plies of the sheet is 2, the sheet forms two layers at the all positions in the circumferential direction of the shaft.

For example, if the number of plies of the sheet is 1.5, the sheet is wound by 1.5 rounds in the circumferential direction. When the number of plies of the sheet is 1.5, the sheet forms one layer at the circumferential position of 0 to 180 degrees, and forms two layers at the circumferential position of 180 degrees to 360 degrees.

In respect of suppressing winding fault such as wrinkles, a sheet having a too large width is not preferable. In this respect, the number of plies of one bias sheet is preferably equal to or less than 4, and more preferably equal to or less than 3. In respect of the working efficiency of the winding process, the number of plies of the bias sheet is preferably equal to or greater than 1.

In respect of suppressing winding fault such as wrinkles, a sheet having a too large width is not preferable. In this respect, the number of plies of one straight sheet is preferably equal to or less than 4, more preferably equal to or less than 3, and still more preferably equal to or less than 2. In respect of the working efficiency of the winding process, the number of plies of the straight sheet is preferably equal to or greater than 1. The number of plies may be 1 in all the straight sheets.

In a full length sheet, winding fault is apt to be generated. In respect of suppressing the winding fault, the number of plies of one sheet in all full length straight sheets is preferably equal to or less than 2. The number of plies may be 1 in all the full length straight sheets.

In respect of suppressing winding fault such as wrinkles, a sheet having a too large width is not preferable. In this respect, the number of plies of the hoop sheet is preferably equal to or less than 4, more preferably equal to or less than 3, and still more preferably equal to or less than 2. In respect of the working efficiency of the winding process, the number of plies of one hoop sheet is preferably equal to or greater than 1. In all the hoop sheets (hoop layers), the number of plies may be equal to or less than 2. In Example 1 to be described later, or the like, the number of plies is 1 in all the hoop sheets (hoop layers).

Winding fault is apt to be generated in the full length sheet. In respect of suppressing the winding fault, the number of plies of one sheet in all full length hoop sheets is preferably equal to or less than 2. The number of plies may be 1 in all the full length hoop sheets.

Although not shown in the drawings, the prepreg sheet before being used is sandwiched between cover sheets. The cover sheets are usually a mold release paper and a resin film. The prepreg sheet before being used is sandwiched between the mold release paper and the resin film. The mold release paper is applied on one surface of the prepreg sheet, and the resin film is applied on the other surface of the prepreg sheet. Hereinafter, the surface on which the mold release paper is applied is also referred to as "a surface of a mold release paper side", and the surface on which the resin film is applied is also referred to as "a surface of a film side".

In the developed view of the present application, the surface of the film side is the front side. That is, in FIG. 2, the front side of the figure is the surface of the film side, and the back side of the figure is the surface of the mold release paper side. In FIG. 2, the direction of a line showing the direction of the fiber of the sheet s2 is the same as the direction of a line showing the direction of the fiber of the sheet s4. However, in the case of stacking, the sheet s4 is reversed. As a result, the directions of the fibers of the sheets s2 and s4 are opposite to each other. As a result, the direction of the fiber of the sheet s2 is set to −45 degrees, and the direction of the fiber of the sheet s4 is set to +45 degrees.

In order to wind the prepreg sheet, the resin film is first peeled. The surface of the film side is exposed by peeling the resin film. The exposed surface has tacking property (tackiness). The tacking property is caused by the matrix resin. That is, since the matrix resin is in a semicured state, the tackiness is developed. The edge part of the exposed surface of the film side is also referred to as a winding start edge part. Next, the winding start edge part is applied to a wound object. The winding start edge part can be smoothly applied due to the tackiness of the matrix resin. The wound object is a mandrel or a wound article obtained by winding the other prepreg sheet(s) around the mandrel. Next, the mold release paper is peeled. Next, the wound object is rotated to wind the prepreg sheet around the wound object. In this way, after the resin film is peeled and the winding start edge part is applied to the wound object, the mold release paper is peeled. The procedure suppresses wrinkles and winding fault of the sheet. This is because the sheet to which the mold release paper is applied is supported by the mold release paper, and is less likely to cause wrinkles. The mold release paper has flexural rigidity higher than the flexural rigidity of the resin film.

In the embodiment of FIG. 2, a united sheet is formed. The united sheet is formed by stacking two or more sheets.

In the embodiment of FIG. 2, three united sheets are formed. A first united sheet is formed by stacking the sheet s2, the sheet s3, and the sheet s4. A second united sheet is formed by stacking the sheet s5 and the sheet s6. A third united sheet is formed by stacking the sheet s8 and the sheet s9. All the hoop sheets s3 and s8 are wound in a state of the united sheet. The winding fault of the hoop sheet is suppressed by the winding method. Examples of the winding fault include the splitting of the sheet, the error of the angle Af, and wrinkles.

As described above, in the present application, the sheet and the layer are classified by the orientation angle of the fiber. Furthermore, in the present application, the sheet and the layer are classified by the axial direction length of the shaft.

In the present application, a layer substantially wholly disposed in the axial direction of the shaft is referred to as a full length layer. In the present application, a sheet substantially wholly disposed in the axial direction of the shaft is referred to as a full length sheet. The wound full length sheet forms the full length layer.

A point separated by 20 mm in the axis direction from the tip end Tp is defined as Tp1, and a range between the tip end Tp and the point Tp1 is defined as a first range. A point separated by 100 mm in the axis direction from the butt end Bt is defined as Bt1, and a range between the butt end Bt and the point Bt1 is defined as a second range. The first range and the second range have a limited influence on the performance of the shaft. From this viewpoint, the full length sheet may not be present in the first range and the second range. Preferably, the full length sheet extends from the tip end Tp to the butt end Bt. In other words, the full length sheet is preferably wholly disposed in the axis direction of the shaft.

In the present application, a layer partially disposed in the axial direction of the shaft is referred to as a partial layer. In the present application, a sheet partially disposed in the axial direction of the shaft is referred to as a partial sheet. The wound partial sheet forms the partial layer. The axial direction length of the partial sheet is shorter than the axial direction length of the full length sheet. Preferably, the axial direction length of the partial sheet is equal to or less than half the full length of the shaft.

In the present application, the full length layer which is the straight layer is referred to as a full length straight layer. In the embodiment of FIG. 2, the full length straight layers are a layer s6, a layer s7 and a layer s9. The full length straight sheets are the sheet s6, the sheet s7 and the sheet s9.

In the present application, the full length layer which is the hoop layer is referred to as a full length hoop layer. In the embodiment of FIG. 2, the full length hoop layers are a layer s3 and a layer s8. The full length hoop sheets are the sheet s3 and the sheet s8.

In the present application, the partial layer which is the straight layer is referred to a partial straight layer. In the embodiment of FIG. 2, the partial straight layers are a layer s1, a layer s5, and a layer s10. Partial straight sheets are the sheet s1, the sheet s5, and the sheet s10.

In the present application, the partial layer which is the hoop layer is referred to as a partial hoop layer. The embodiment of FIG. 2 does not have the partial hoop layer. In the present invention, the partial hoop layer may be used. In the embodiment of FIG. 2, all the hoop layers are full length hoop layers.

The term "butt partial layer" is used in the present application. Examples of the butt partial layer include a butt partial straight layer and a butt partial hoop layer. In the embodiment of FIG. 2, the butt partial straight layer is the layer s5. Butt partial straight sheet is the sheet s5. In the embodiment of FIG. 2, the butt partial hoop layer is not provided.

An axial direction distance between the butt partial layer (butt partial sheet) and the butt end Bt of the shaft is shown by a double-pointed arrow Db in FIG. 2. The axial direction distance Db is preferably equal to or less than 100 mm, more preferably equal to or less than 50 mm, and still more preferably 0 mm. In the embodiment, the axial direction distance Db is 0 mm.

The term "tip partial layer" is used in the present application. An axial direction distance between the tip partial layer (tip partial sheet) and the tip end Tp of the shaft is shown by a double-pointed arrow Dt in FIG. 2. The axial direction distance Dt is preferably equal to or less than 40 mm, more preferably equal to or less than 30 mm, still more preferably equal to or less than 20 mm, and yet still more preferably 0 mm. In the embodiment, the axial direction distance Dt is 0 mm. In all the tip partial layers, the distance Dt is 0 mm. The tip partial layer is formed by the tip partial sheet.

Examples of the tip partial layer include a tip partial straight layer. In the embodiment of FIG. 2, the tip partial straight layers are the layer s1 and the layer s10. The tip partial straight sheets are the sheet s1 and the sheet s10. The tip partial layer increases the strength of a tip portion of the shaft 6.

The shaft 6 is produced by the sheetwinding method using the sheets shown in FIG. 2.

Hereinafter, a manufacturing process of the shaft 6 will be schematically described.

[Outline of Manufacturing Process of Shaft]

(1) Cutting Process

The prepreg sheet is cut into a desired shape in the cutting process. Each of the sheets shown in FIG. 2 is cut out by the process.

The cutting may be performed by a cutting machine. The cutting may be manually performed. In the manual case, for example, a cutter knife is used.

(2) Stacking Process

In the stacking process, the three united sheets described above are produced.

In the stacking process, heating or a press may be used. More preferably, the heating and the press are used in combination. In a winding process to be described later, the deviation of the sheet may be generated during the winding operation of the united sheet. The deviation reduces winding accuracy. The heating and the press improve an adhesive force between the sheets. The heating and the press suppress the deviation between the sheets in the winding process.

(3) Winding Process

A mandrel is prepared in the winding process. A typical mandrel is made of a metal. A mold release agent is applied to the mandrel. Furthermore, a resin having tackiness is applied to the mandrel. The resin is also referred to as a tacking resin. The cut sheet is wound around the mandrel. The tacking resin facilitates the application of the end part of the sheet to the mandrel.

The sheets are wound in order described in the developed view. The sheet located on a more upper side in the developed view is earlier wound. The sheets to be stacked are wound in a state of the united sheet.

A winding body is obtained in the winding process. The winding body is obtained by winding the prepreg sheet around the outside of the mandrel. For example, the winding is achieved by rolling the wound object on a plane. The winding may be performed by a manual operation or a machine. The machine is referred to as a rolling machine.

(4) Tape Wrapping Process

A tape is wrapped around the outer peripheral surface of the winding body in the tape wrapping process. The tape is also referred to as a wrapping tape. The tape is wrapped while tension is applied to the tape. A pressure is applied to the winding body by the wrapping tape. The pressure reduces voids.

(5) Curing Process

In the curing process, the winding body after performing the tape wrapping is heated. The heating cures the matrix resin. In the curing process, the matrix resin fluidizes temporarily. The fluidization of the matrix resin can discharge air between the sheets or in the sheet. The pressure (fastening force) of the wrapping tape accelerates the discharge of the air. The curing provides a cured laminate.

(6) Process of Extracting Mandrel and Process of Removing Wrapping Tape

The process of extracting the mandrel and the process of removing the wrapping tape are performed after the curing process. The process of removing the wrapping tape is preferably performed after the process of extracting the mandrel in respect of improving the efficiency of the process of removing the wrapping tape.

(7) Process of Cutting Both Ends

Both the end parts of the cured laminate are cut in the process. The cutting flattens the end face of the tip end Tp and the end face of the butt end Bt.

In order to facilitate the understanding, in all the developed views of the present application, the sheets after both the ends are cut are shown. In fact, the cutting of both the ends is considered in the size in cutting. That is, in fact, the cutting is performed in a state where the sizes of both end portions to be cut are added.

(8) Polishing Process

The surface of the cured laminate is polished in the process. Spiral unevenness is present on the surface of the cured laminate. The unevenness is the trace of the wrapping tape. The polishing extinguishes the unevenness to smooth the surface of the cured laminate. Preferably, whole polishing and tip partial polishing are conducted in the polishing process.

(9) Coating Process

The cured laminate after the polishing process is subjected to coating.

The shaft 6 is obtained in the processes. The shaft 6 is lightweight, and has excellent strength.

An axial direction length of the tip partial layer is shown by a double-pointed arrow T1 in FIG. 2. From the viewpoint of the strength of the tip portion of the shaft, the axial direction length T1 is preferably equal to or greater than 50 mm, more preferably equal to or greater than 100 mm, and still more preferably equal to or greater than 150 mm. From the viewpoint of the weight saving of the shaft, the axial direction length T1 is preferably equal to or less than 400 mm, more preferably equal to or less than 350 mm, and still more preferably equal to or less than 300 mm.

An axial direction length of the butt partial layer is shown by a double-pointed arrow B1 in FIG. 2. An increase in the butt partial layer makes the center of gravity of the shaft approach the butt end Bt. In this case, the easiness of swing can be increased. From this viewpoint, the axial direction length B1 is preferably equal to or greater than 50 mm, more preferably equal to or greater than 100 mm, and still more preferably equal to or greater than 150 mm. From the viewpoint of the weight saving of the shaft, the axial direction length B1 is preferably equal to or less than 500 mm, more preferably equal to or less than 400 mm, and still more preferably equal to or less than 300 mm.

In the embodiment, a carbon fiber reinforced prepreg and a glass fiber reinforced prepreg are used. Examples of the carbon fiber include a PAN based carbon fiber and a pitch based carbon fiber.

As described above, a laminated constitution A shown in FIG. 2 includes sheets to be shown below.

[Laminated Constitution A]

First Sheet s1: Tip Partial Straight Sheet
Second Sheet s2: Full Length Bias Sheet
Third Sheet s3: Full Length Hoop Sheet
Fourth Sheet s4: Full Length Bias Sheet
Fifth Sheet s5: Butt Partial Straight Sheet
Sixth Sheet s6: Full Length Straight Sheet
Seventh Sheet s7: Full Length Straight Sheet
Eighth Sheet s8: Full Length Hoop Sheet
Ninth Sheet s9: Full Length Straight Sheet
10th Sheet s10: Tip Partial Straight Sheet In the laminated constitution A, the sheet s3 is a first hoop sheet. In the laminated constitution A, the sheet s8 is a second hoop sheet. The sheet s3 is set to one ply. The sheet s8 is set to one ply. In the laminated constitution A, the number of the hoop layers is 2.

In the laminated constitution A, an interposition layer is present between a first hoop layer s3 and a second hoop layer s8. The interposition layer is a layer other than the hoop layer. In the laminated constitution A, the interposition layer is varied depending on the axial direction position of the shaft. In a range in which a butt partial layer s5 is present, interposition sheets are a layer s4, a layer s5, a layer s6, and a layer s7. In a range in which the butt partial layer s5 is not present, the interposition layers are the layer s4, the layer s6, and the layer s7.

In the laminated constitution A, the interposition layer includes a bias layer. The bias layer is a full length layer (full length bias sheet). In the laminated constitution A, the interposition layer includes a butt partial layer. In the laminated constitution A, the interposition layer includes a full length straight layer.

The first hoop layer s3 is disposed between a first bias layer s2 and a second bias layer s4. The full length layer which is present inside the first hoop layer s3 is only a first bias layer. The full length layer which is present outside the second hoop layer s8 is only the straight layer.

Figure 3:
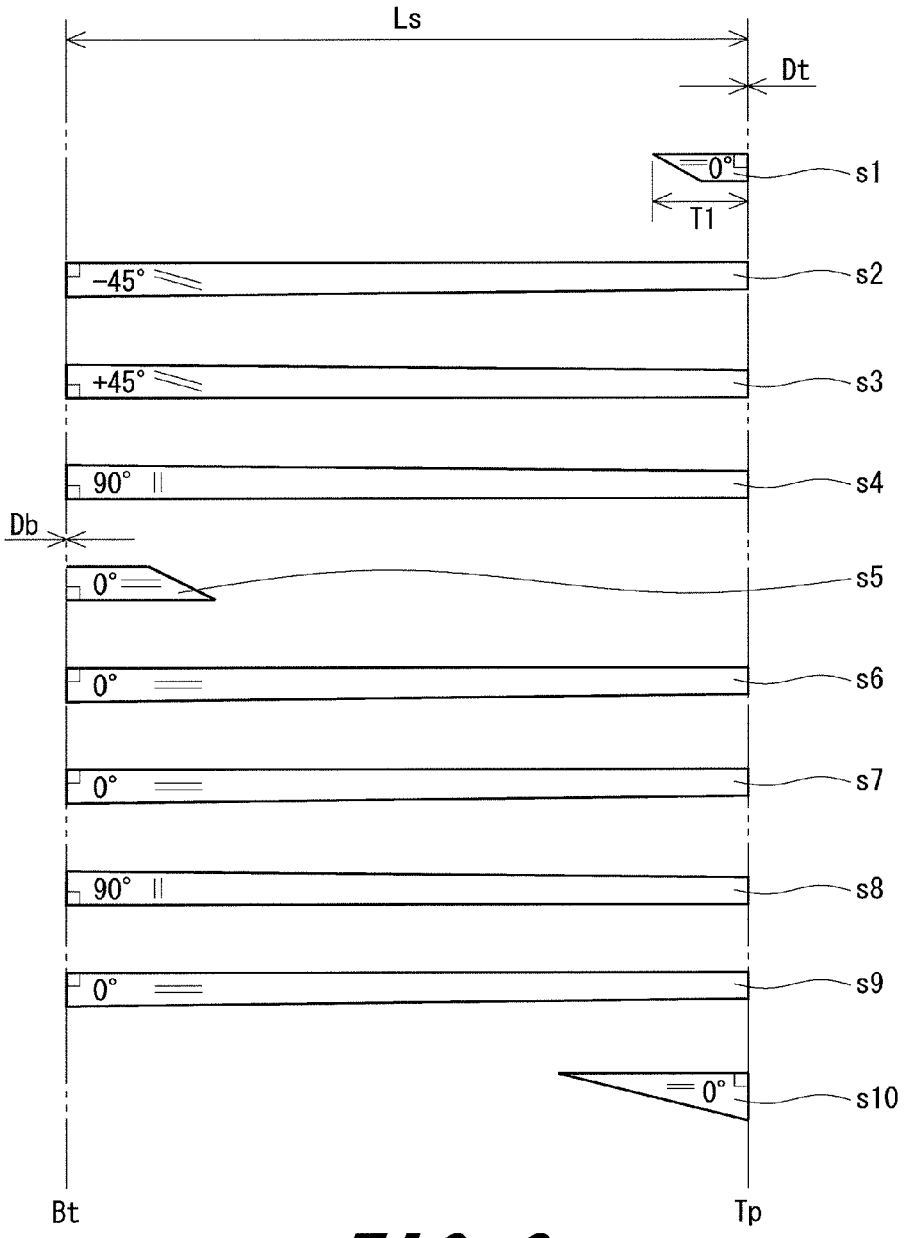
FIG. 3 is a developed view showing another laminated constitution (laminated constitution B)

FIG. 3 shows a laminated constitution B. Each sheet constituting the laminated constitution B is as follows. In the laminated constitution B, the first hoop sheet moves to the fourth sheet s4.

[Laminated Constitution B]

First Sheet s1: Tip Partial Straight Sheet
Second Sheet s2: Full Length Bias Sheet
Third Sheet s3: Full Length Bias Sheet
Fourth Sheet s4: Full Length Hoop Sheet
Fifth Sheet s5: Butt Partial Straight Sheet
Sixth Sheet s6: Full Length Straight Sheet
Seventh Sheet s7: Full Length Straight Sheet
Eighth Sheet s8: Full Length Hoop Sheet
Ninth Sheet s9: Full Length Straight Sheet
10th Sheet s10: Tip Partial Straight Sheet In the laminated constitution B, the sheet s4 is the first hoop sheet. In the laminated constitution B, the sheet s8 is the second hoop sheet. The sheet s4 is set to one ply. The sheet s8 is set to one ply. In the laminated constitution B, the number of the hoop layer is 2.

In the laminated constitution B, the interposition layer is present between the first hoop layer s4 and the second hoop layer s8. The interposition layer is a layer other than the hoop layer. In the laminated constitution B, the interposition layer is varied depending on the axial direction position of the shaft. At a position where the butt partial layer s5 is present, the interposition sheets are the layer s5, the layer s6, and the layer s7. At a position where the butt partial layer s5 is not present, the interposition layers are the layer s6 and the layer s7. The interposition layer is only the straight layer. Except for the butt partial layer s5, the interposition layer is only the full length straight layer.

In the laminated constitution B, the interposition layer does not include the bias layer. In the laminated constitution B, the interposition layer includes the butt partial layer. In the laminated constitution B, the interposition layer includes the full length straight layer. The interposition layer includes the full length straight layer set to two plies or greater.

A layer including the first bias layer s2 and the second bias layer s3 is also referred to as a bias layer pair s23. The first hoop layer s4 is brought into contact with the bias layer pair s23, and is disposed outside the bias layer pair s23. The full length layer being present inside the first hoop layer s4 is only the bias layer pair s23. The full length layer being present outside the second hoop layer s8 is only the straight layer.

Figure 4:
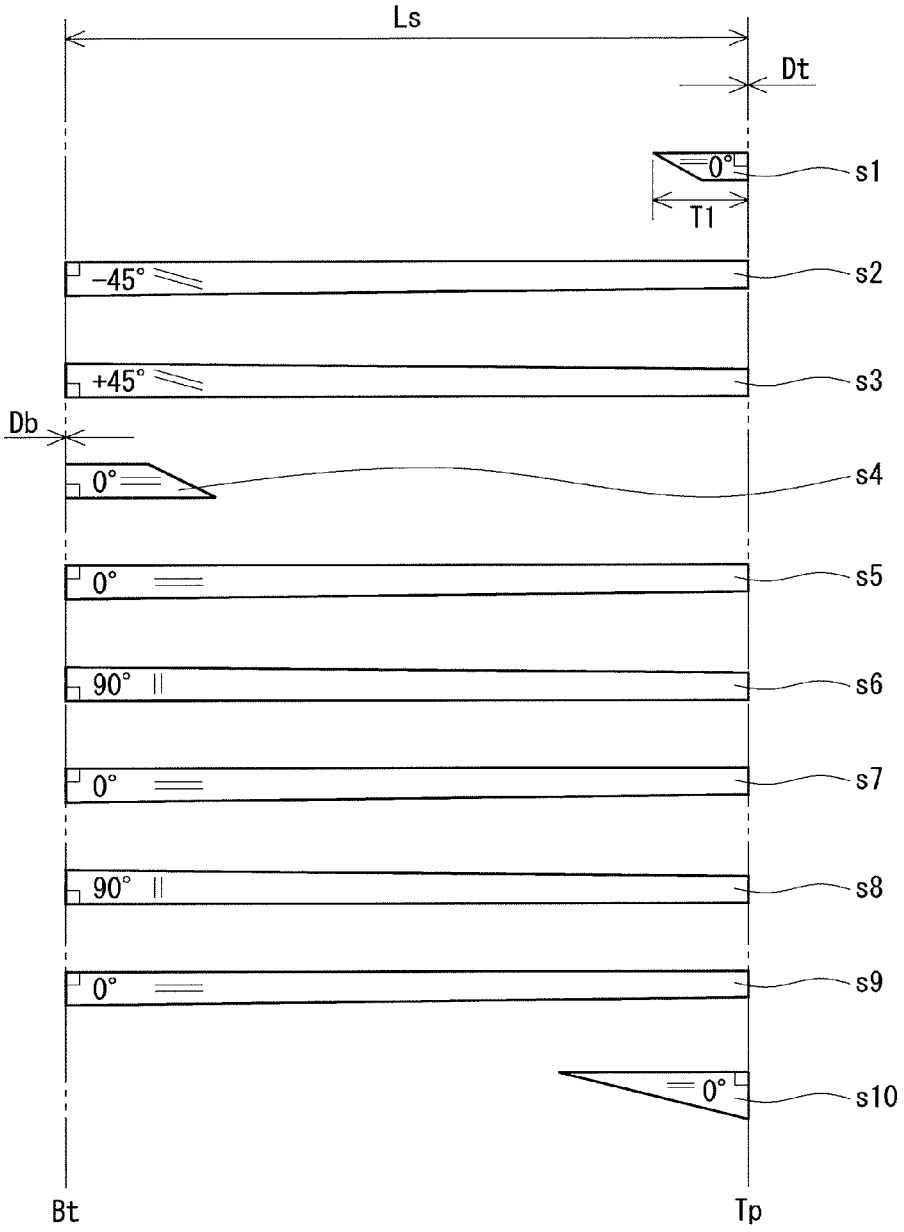
FIG. 4 is a developed view showing still another laminated constitution (laminated constitution C)

FIG. 4 shows a laminated constitution C. Each sheet constituting the laminated constitution C is as follows. In the laminated constitution C, the first hoop sheet moves to the sixth sheet s6.

[Laminated Constitution C]

First Sheet s1: Tip Partial Straight Sheet
Second Sheet s2: Full Length Bias Sheet
Third Sheet s3: Full Length Bias Sheet
Fourth Sheet s4: Butt Partial Straight Sheet
Fifth Sheet s5: Full Length Straight Sheet
Sixth Sheet s6: Full Length Hoop Sheet
Seventh Sheet s7: Full Length Straight Sheet
Eighth Sheet s8: Full Length Hoop Sheet
Ninth Sheet s9: Full Length Straight Sheet
10th Sheet s10: Tip Partial Straight Sheet In the laminated constitution C, the sheet s6 is the first hoop sheet. In the laminated constitution C, the sheet s8 is the second hoop sheet. The sheet s6 is set to one ply. The sheet s8 is set to one ply. In the laminated constitution C, the number of the hoop layers is 2.

In the laminated constitution C, the interposition layer is present between the first hoop layer s6 and the second hoop layer s8. The interposition layer is a layer other than the hoop layer. The interposition layer is the layer s7. The interposition layer is only the straight layer. The interposition layer is only the full length straight layer.

In the laminated constitution C, the interposition layer does not include the bias layer. In the laminated constitution C, the interposition layer does not include the partial layer. In the laminated constitution C, the interposition layer includes the full length straight layer.

The first hoop layer s6 is located outside the bias layer pair s23. The first hoop layer s6 is not brought into contact with the bias layer pair s23. The full length layer s5 is interposed between the first hoop layer s6 and the bias layer pair s23. The full length straight layer s5 is interposed between the first hoop layer s6 and the bias layer pair s23. The full length layer being present outside the second hoop layer s8 is only the straight layer.

Figure 5:
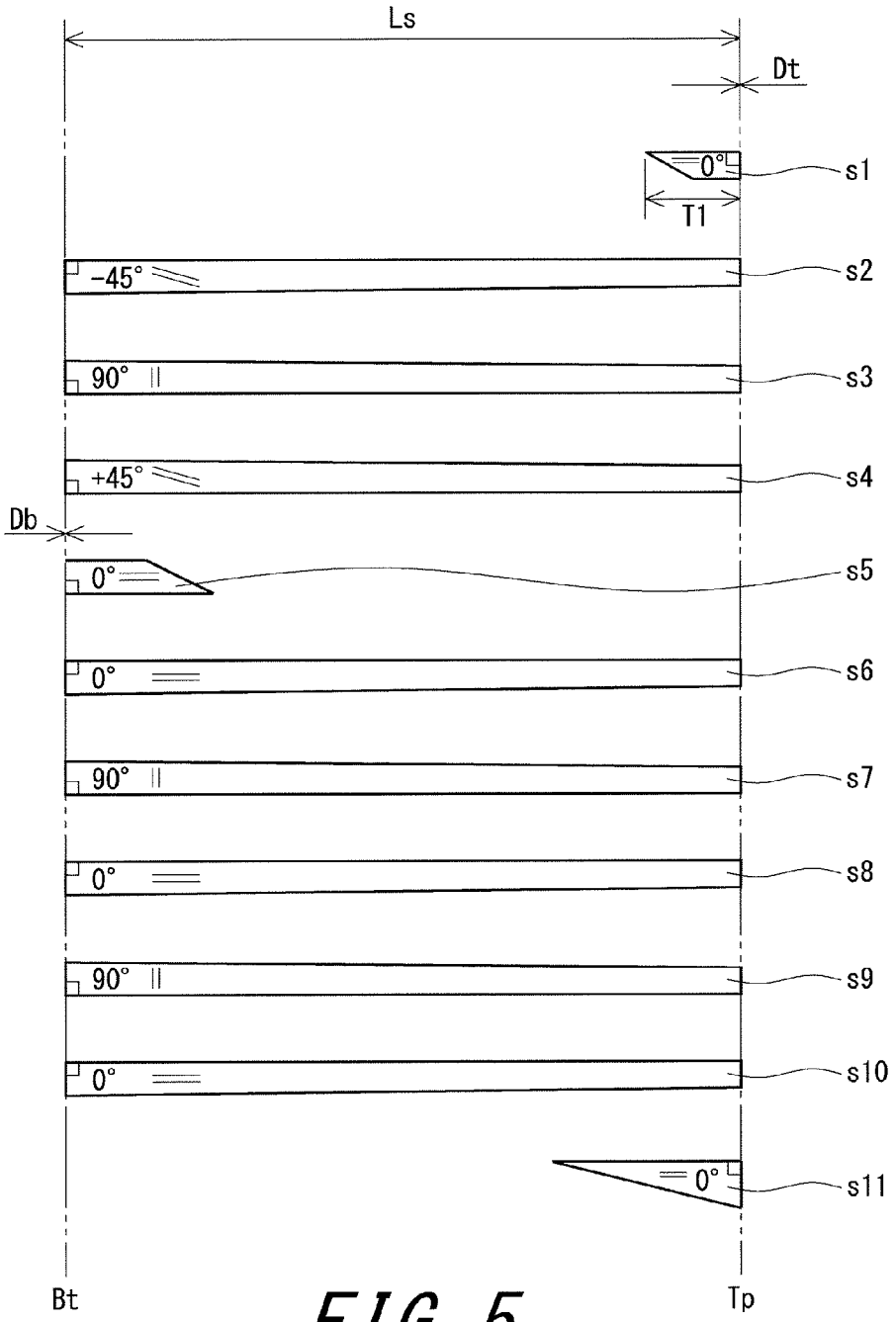
FIG. 5 is a developed view showing still another laminated constitution (laminated constitution D)

FIG. 5 shows a laminated constitution D. Each sheet constituting the laminated constitution D is as follows. In the laminated constitution D, three hoop sheets are used.

[Laminated Constitution D]

First Sheet s1: Tip Partial Straight Sheet
Second Sheet s2: Full Length Bias Sheet
Third Sheet s3: Full Length Hoop Sheet
Fourth Sheet s4: Full Length Bias Sheet
Fifth Sheet s5: Butt Partial Straight Sheet
Sixth Sheet s6: Full Length Straight Sheet
Seventh Sheet s7: Full Length Hoop Sheet
Eighth Sheet s8: Full Length Straight Sheet
Ninth Sheet s9: Full Length Hoop Sheet
10th Sheet s10: Full Length Straight Sheet
11th sheet s11: Tip Partial Straight Sheet In the laminated constitution D, the sheet s3 is the first hoop sheet. In the laminated constitution D, the sheet s7 is the second hoop sheet. In the laminated constitution D, the sheet s9 is a third hoop sheet. The first hoop sheet s3 is set to one ply. The second hoop sheet s7 is set to one ply. The third hoop sheet s9 is set to one ply. In the laminated constitution D, the number of the hoop layers is 3.

In the laminated constitution D, a first interposition layer is present between the first hoop layer s3 and the second hoop layer s7. In a range in which the partial layer s5 is present, the first interposition layer is constituted with the layer s4, the layer s5, and the layer s6. In a range in which the partial layer s5 is not present, the first interposition layer is constituted with the layer s4 and the layer s6.

In the laminated constitution D, a second interposition layer is present between the second hoop layer s7 and the third hoop layer s9. The second interposition layer is constituted with the full length layer s8. The second interposition layer is constituted with the full length straight layer s8.

Thus, the laminated constitution D has the three hoop layers which are not brought into contact with each other. Therefore, the laminated constitution D includes the two interposition layers.

The first hoop layer s3 is sandwiched between the first bias layer and the second bias layer. The second hoop layer s7 is sandwiched between the straight layers. The third hoop layer s9 is sandwiched between the straight layers.

Figure 6:
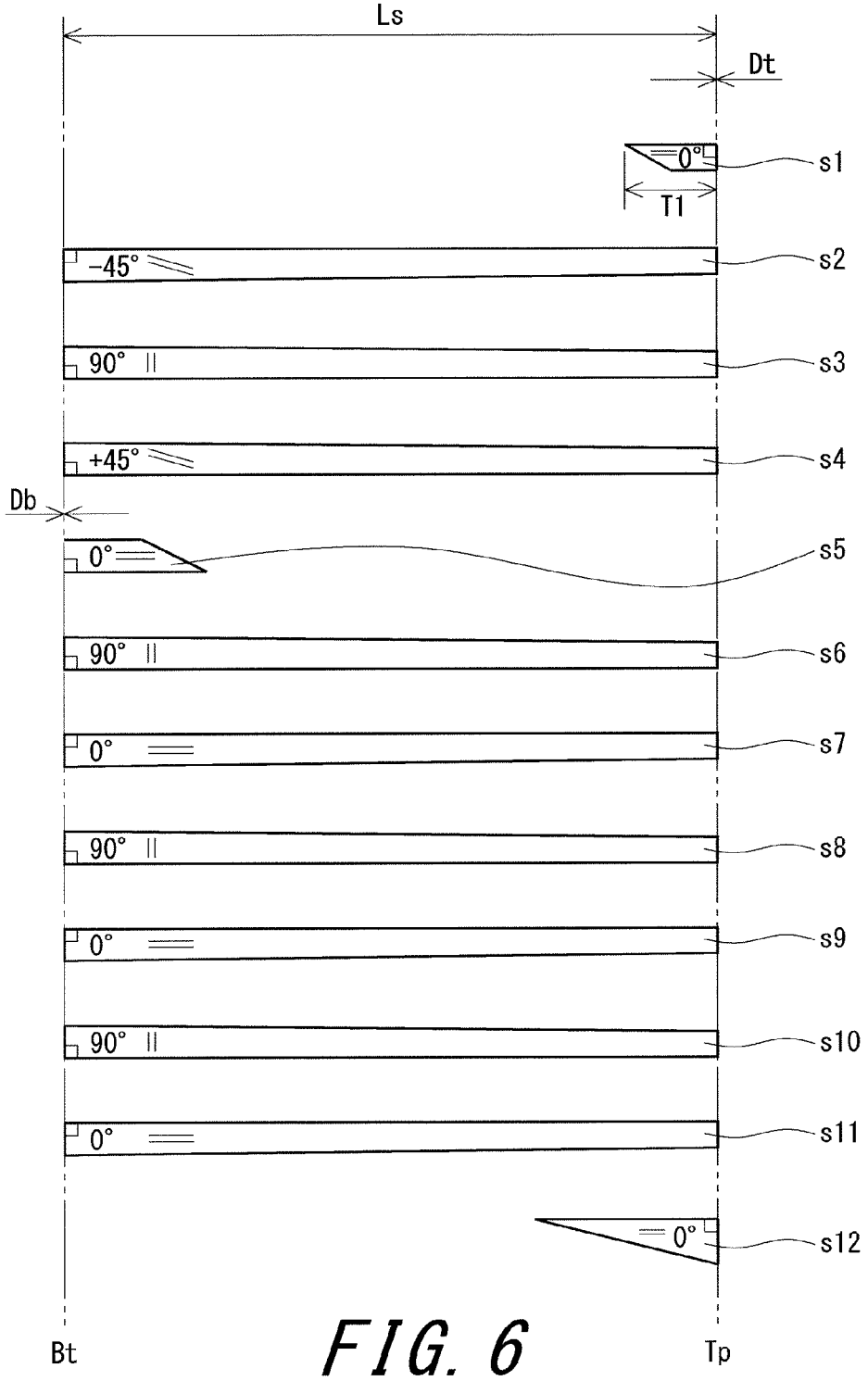
FIG. 6 is a developed view showing still another laminated constitution (laminated constitution E)

FIG. 6 shows a laminated constitution E. Each sheet constituting the laminated constitution E is as follows. Four hoop sheets are used in the laminated constitution E.

[Laminated Constitution E]

First Sheet s1: Tip Partial Straight Sheet
Second Sheet s2: Full Length Bias Sheet
Third Sheet s3: Full Length Hoop Sheet
Fourth Sheet s4: Full Length Bias Sheet
Fifth Sheet s5: Butt Partial Straight Sheet
Sixth Sheet s6: Full Length Hoop Sheet
Seventh Sheet s7: Full Length Straight Sheet
Eighth Sheet s8: Full Length Hoop Sheet
Ninth Sheet s9: Full Length Straight Sheet
10th Sheet s10: Full Length Hoop Sheet
11th sheet s11: Full Length Straight Sheet
12th sheet s12: Tip Partial Straight Sheet In the laminated constitution E, the sheet s3 is the first hoop sheet. In the laminated constitution E, the sheet s6 is the second hoop sheet. In the laminated constitution E, the sheet s8 is the third hoop sheet. In the laminated constitution E, the sheet s10 is a fourth hoop sheet.

The first hoop sheet s3 is set to one ply. The second hoop sheet s6 is set to one ply. The third hoop sheet s8 is set to one ply. The fourth hoop sheet s10 is set to one ply. In the laminated constitution E, the number of the hoop layers is 4.

In the laminated constitution E, the first interposition layer is present between the first hoop layer s3 and the second hoop layer s6. In a range in which the partial layer s5 is present, the first interposition layer is constituted with the layer s4 and the layer s5. In a range in which the partial layer s5 is not present, the first interposition layer is constituted with the layer s4.

In the laminated constitution E, the second interposition layer is present between the second hoop layer s6 and the third hoop layer s8. The second interposition layer is constituted with the full length layer s7. The second interposition layer is constituted with the full length straight layer s7.

In the laminated constitution E, a third interposition layer is present between the third hoop layer s8 and the fourth hoop layer s10. The third interposition layer is constituted with a full length layer s9. The third interposition layer is constituted with a full length straight layer s9.

Thus, the laminated constitution E includes the four hoop layers which are not brought into contact with each other. Therefore, the laminated constitution E includes the three interposition layers.

The first hoop layer s3 is sandwiched between the first bias layer and the second bias layer. The second hoop layer s6 is sandwiched between the bias layer (or the partial straight layer) and the full length straight layer. The third hoop layer s8 is sandwiched between the straight layers. The fourth hoop layer s10 is sandwiched between the straight layers.

Figure 7:
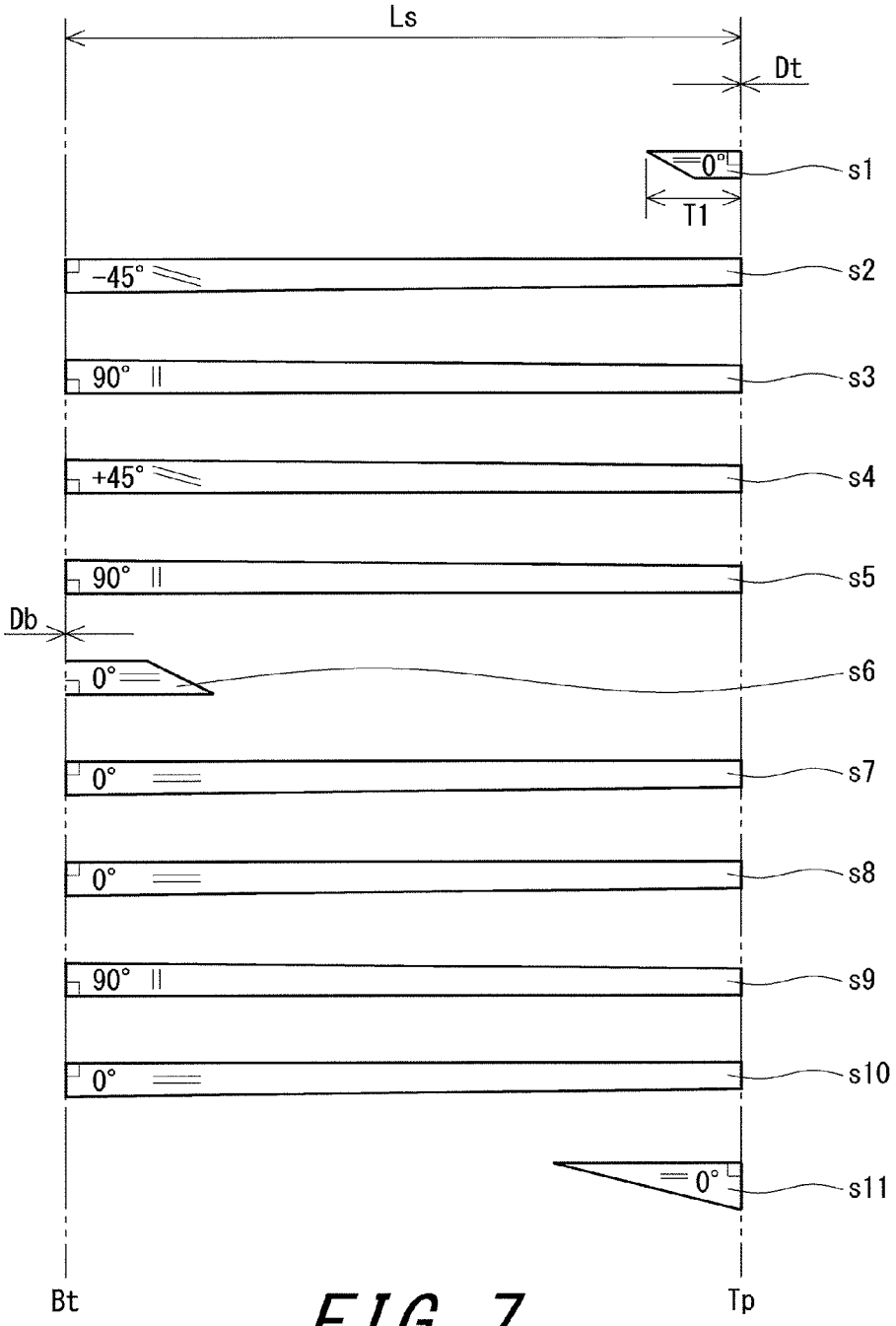
FIG. 7 is a developed view showing still another laminated constitution (laminated constitution F)

FIG. 7 shows a laminated constitution F. Each sheet constituting laminated constitution F is as follows. In the laminated constitution F, three hoop sheets are used.

[Laminated Constitution F]

First Sheet s1: Tip Partial Straight Sheet
Second Sheet s2: Full Length Bias Sheet
Third Sheet s3: Full Length Hoop Sheet
Fourth Sheet s4: Full Length Bias Sheet
Fifth Sheet s5: Full Length Hoop Sheet
Sixth Sheet s6: Butt Partial Straight Sheet
Seventh Sheet s7: Full Length Straight Sheet
Eighth Sheet s8: Full Length Straight Sheet
Ninth Sheet s9: Full Length Hoop Sheet
10th Sheet s10: Full Length Straight Sheet
11th sheet s11: Tip Partial Straight Sheet In the laminated constitution F, the sheet s3 is the first hoop sheet. In the laminated constitution F, the sheet s5 is the second hoop sheet. In the laminated constitution F, the sheet s9 is the third hoop sheet.

The first hoop sheet s3 is set to one ply. The second hoop sheet s5 is set to one ply. The third hoop sheet s9 is set to one ply. In the laminated constitution F, the number of the hoop layers is 3.

In the laminated constitution F, the first interposition layer is present between the first hoop layer s3 and the second hoop layer s5. The first interposition layer is constituted with the bias layer s4. The first interposition layer is constituted with a full length bias layer s4.

In the laminated constitution F, the second interposition layer is present between the second hoop layer s5 and the third hoop layer s9. In a range in which the partial layer s6 is present, the second interposition layer is constituted with the layer s6, the layer s7, and the layer s8. In a range in which the partial layer s6 is not present, the second interposition layer is constituted with the layer s7 and the layer s8.

Thus, the laminated constitution F has the three hoop layers which are not brought into contact with each other. Therefore, the laminated constitution F includes the two interposition layers.

The first hoop layer s3 is sandwiched between the first bias layer and the second bias layer. The second hoop layer s5 is sandwiched between the bias layer and the full length straight layer (or the partial straight layer). The third hoop layer s9 is sandwiched between the straight layers.

As described above, each of the laminated constitutions A to F includes at least two hoop layers, at least one bias layer, and at least one straight layer.

[Between Opposing Hoop Layers]

In all the laminated constitutions A to F, the interposition layer other than the hoop layer is present between every opposing hoop layers. For example, since the number of the hoop layers is 3 in the laminated constitution D (FIG. 5), "between every opposing hoop layers" is "between the layer 3 and the layer 7" and "between the layer 7 and the layer 9". For example, since the number of the hoop layers is 4 in the laminated constitution E (FIG. 6), "between every opposing hoop layers" is "between the layer 3 and the layer 6", "between the layer 6 and the layer 8", and "between the layer 8 and the layer 10". In the laminated constitutions A to F, a layer "other than the hoop layer" is the bias layer and/or the straight layer. Another examples of the layer "other than the hoop layer" include a layer containing a woven fiber.

For example, the case where a hoop layer A, a hoop layer B, and a hoop layer C are present in order from the radial inside is considered. The number of "between every opposing hoop layers" is 2: (1) between the hoop layer A and the hoop layer B; and (2) between the hoop layer B and the hoop layer C. Only the hoop layer B "opposes" the hoop layer A. Due to the presence of the hoop layer B, the hoop layer A is not interpreted to oppose the hoop layer C. Therefore, the interposition layer does not include the hoop layer inevitably.

[Average Thickness t]

In the present application, the average thickness of the opposing hoop layers is defined as t. The "average" means that the average value of both the hoop layers opposing each other is employed. For example, in the laminated constitution A (FIG. 2), the average value of the thickness of the hoop sheet s3 and the thickness of the hoop sheet s8 is the thickness t. The thickness t is set in all the hoop layers opposing each other. For example, in the laminated constitution E (FIG. 6), the thicknesses of the layer 3 and the thickness of the layer 6 are averaged, to set the thickness t (t1) for "between the layers". Furthermore, the thickness of the layer 6 and the thickness of the layer 8 are averaged, to set the thickness t (t2) for "between the layers". Furthermore, the thickness of the layer 8 and the thickness of the layer 10 are averaged, to set the thickness t (t3) for "between the layers". The unit of the thickness t is mm.

[Total Thickness T of Interposition Layer]

The total thickness of the interposition layer interposed between the hoop layers opposing each other is defined as T. The unit of the thickness T is mm.

[Total Number P of Plies of Interposition Layer]

The total winding number of the interposition layer is the total number P of plies. The total number P of plies may not be an integer. For example, the number P of plies the interposition layer wound by 1.5 rounds is 1.5.

[T/t]

A ratio (T/t) can be calculated between every opposing hoop layers. When T/t is varied depending on the axial direction position, a minimum value is employed. Therefore, for example, when a partial layer is interposed between the opposing hoop layers, the partial layer may be disregarded in the calculation of T/t.

When the number of the hoop layers is equal to or greater than 3, a plurality of T/t can be calculated. In this case, the average value of T/t is T/t of the shaft.

[P/t]

A ratio (P/t) can be calculated between every opposing hoop layers. When P/t is varied depending on the axial direction position, a minimum value is employed. Therefore, for example, when a partial layer is interposed between the opposing hoop layers, the partial layer may be disregarded in the calculation of P/t.

When the number of the hoop layers is equal to or greater than 3, a plurality of P/t can be calculated. In this case, the average value of P/t is P/t of the shaft.

Even when the hoop layer is not the full length layer, T/t and P/t are set. In other words, even when the hoop layer is the partial layer, T/t and P/t are set. When the hoop layer is the partial layer, T/t and P/t are determined in an axial range where the partial hoop layer is present.

For example, in the laminated constitution D (FIG. 5), the case where the hoop layer s7 is replaced by the butt partial hoop layer is considered. The length of the butt partial hoop layer is set to be a half of the shaft length. In this case, three interposition layers are present. That is, a first interposition layer is a layer between the layer s3 and the layer s7. A second interposition layer is a layer between the layer s7 and the layer s9. A third interposition layer is a layer between the layer s3 and the layer s9. The first interposition layer and the second interposition layer are present on a butt side. The third interposition layer is present on a tip side. T/t and P/t can be calculated in each of the first, second, and third interposition layers. In such a case, T/t and P/t of the shaft are average values of three values.

Preferably, T/t is equal to or greater than 1.9. That is, a preferable shaft satisfies the following formula (1):

$$T/t \geq 1.9 \quad (1).$$

More preferably, T/t is equal to or greater than 2.2. That is, a more preferable shaft satisfies the following formula (3):

$$T/t \geq 2.2 \quad (3).$$

Still more preferably, T/t is equal to or greater than 2.5. That is, a more preferable shaft satisfies the following formula (4):

$$T/t \geq 2.5 \quad (4).$$

The upper limit of T/t is not limited. From the viewpoint of the weight saving of the shaft, T/t is preferably equal to or less than 5.5, more preferably equal to or less than 5.0, and still more preferably equal to or less than 4.5.

The shaft strength can be increased by increasing T/t. The reason why the effect is exhibited is not clarified. The hoop layer dispersed in the radial direction is considered to increase the shaft strength under some sort of operation.

If the total number of plies of the interposition layer is defined as P, P/t is preferably equal to or greater than 30. That is, a more preferable shaft satisfies the following formula (2):

$$P/t \geq 30 \quad (2).$$

The shaft strength can be increased by increasing P/t. The reason why the effect is exhibited is not clarified. The hoop layer dispersed in the radial direction is considered to increase the shaft strength under some sort of operation.

More preferably, P/t is preferably equal to or greater than 40, more preferably equal to or greater than 50, and still more preferably equal to or greater than 60. The upper limit of P/t is not limited. In light of a shaft weight or the like, usually, P/t is preferably equal to or less than 100, and more preferably equal to or less than 90.

In the present application, a thickness Tm of the hoop layer located on an outermost side in the radial direction is considered. For example, in the laminated constitution E (FIG. 6), four hoop layers are provided. Among them, the hoop layer located on the outermost side in the radial direction is the layer s10. The thickness Tm is preferably equal to or greater than 0.050 mm. The thickness is greater than the thickness of the conventional hoop layer. The strength can be increased by disposing the hoop layer thicker than before outside. From the viewpoint of the strength, the thickness Tm is preferably equal to or greater than 0.055 mm, and more preferably equal to or greater than 0.060 mm. From the viewpoint of winding workability, the thickness Tm is preferably equal to or less than 0.090 mm, more preferably equal to or less than 0.080 mm, and still more preferably equal to or less than 0.070 mm.

The fiber is predisposed into a straight. The predisposition is apt to cause rising when the hoop layer is wound. The rising is a phenomenon in which the prepreg returns to a flat state to release winding. Since the fiber of the hoop layer is perpendicular to the axis direction of the shaft, the rising particularly apt to occur. From the viewpoint of preventing the rising, a thin sheet of about 0.03 mm is conventionally used as the hoop sheet. However, the present inventors found that the strength can be increased by disposing the hoop layer thicker than before outside.

When the hoop layer is thickened, conventional thin sheets are considered to be overlapped. A thin sheet is wound a plurality of times, and thereby the hoop layer can be thickened while the rising can be suppressed.

However, the present inventors found that use of a thick hoop layer can provide an increase in strength as compared with the overlapping of thin hoop layers. Freedom from interlayer peeling is considered to contribute to the increase in strength based on the thick hoop layer. As described later, when the hoop layers are overlapped, the interlayer peeling is apt to occur. However, a difference between the strengths shown in contrast with Example 1 and Comparative Example 4 to be described later is large. It is considered that the difference cannot be described based on only the interlayer peeling. The reason for the increase in strength caused by the thick hoop layer is not completely clarified.

Preferably, a laminated portion X in which the hoop layers are sandwiched between the two bias layers is present in at least a partial range in the axis direction of the shaft. For example, in the laminated constitution A (FIG. 2), the full length hoop layer s3 sandwiched between the first bias layer s2 and the second bias layer s4 is present. Therefore, in the laminated constitution A, the laminated portion X is wholly disposed in the axis direction of the shaft.

During swing, torsion back may occur in the shaft. The torsion back is a phenomenon in which torsion in a face open direction turns back. In the initial stage of downswing, the inertia of the head is apt to cause the torsion of the shaft in the face open direction. The face is apt to be opened upon impact while the torsion is not released. Impact in a state where a face is opened is suppressed in a shaft having large torsion back.

From the viewpoint of the torsion back, the laminated portion X is preferably provided. When the shaft is tortured, the bias layer is deformed so as to reduce the diameter of the bias layer. This deformation is due to the direction of the fiber of the bias layer. The hoop layer in the laminated portion X contributes to the restoration of the reduced diameter. As a result, the torsion back is produced. The laminated portion X can promote the torsion back.

Preferably, a laminated portion Y in which the hoop layers are sandwiched between the two straight layers is present. Preferably, the laminated portion Y is present in at least a partial range in the axis direction of the shaft. For example, in the laminated constitution A (FIG. 2), the full length hoop layer s8 sandwiched between the full length straight layer s7 and the full length straight layer s9 is present. Therefore, in the laminated constitution A, the laminated portion Y is wholly disposed in the axis direction of the shaft.

During swing, deflection back may occur in the shaft. The deflection back is a phenomenon in which deflection in a direction to give the head getting behind turns back. In the initial stage of downswing, the inertia of the head is apt to cause the deflection of the shaft in the direction to give the head getting behind. The face is apt to be opened upon impact in a state to give the head getting behind. In this case, a head speed is apt to be decreased. Furthermore, in this case, impact in upper blow is less likely to occur. Impact in a state where a face is opened is suppressed in a shaft having large deflection back. The head speed can be increased in the shaft having large deflection back. The impact in upper blow is likely to occur in the shaft having large deflection back.

These contribute to an increase in the flight distance and an improvement in hit ball directivity.

From the viewpoint of the deflection back, the laminated portion Y is preferably provided. When the shaft is deflected, the straight layer is deformed so that the straight layer has an almost ellipsoidal cross-section. When a cylinder having a thin thickness is bent, deformation occurs so that the cylinder has an almost ellipsoidal cross-section. The deformation is also referred to as crushing deformation. The laminated portion Y effectively restores the crushing deformation. As a result, the deflection back is produced. The laminated portion Y can promote the deflection back.

The laminated constitution A shown in FIG. 2 includes the laminated portion X and the laminated portion Y. Therefore, the torsion back and the deflection back can act synergistically. For this reason, the stability of a hit ball direction and flight distance performance are improved.

Since the laminated portion X is wholly provided in the axis direction of the shaft in the laminated constitution A shown in FIG. 2, the effect of the torsion back can be exhibited in the whole shaft. Since the laminated portion Y is wholly provided in the axis direction of the shaft, the effect of the deflection back can be exhibited in the whole shaft.

As described above, the torsion deformation causes the crushing deformation. In the crushing deformation, the curvature of the cross-section shape of the shaft is varied depending on a circumferential position. That is, when the elliptical shape is provided by the crushing deformation, a portion having small curvature and a portion having large curvature exist. Since the fibers of the hoop layer are oriented in the circumferential direction, the hoop layer is less likely to follow a change in the curvature. On the other hand, since the fibers of the straight layer and the bias layer are not oriented in the circumferential direction, the straight layer and the bias layer are likely to follow the change in the curvature.

Therefore, when the hoop layers are overlapped, a difference between the radial positions between the hoop layers is apt to cause the interlayer peeling. On the other hand, when the straight layer and the bias layer are overlapped, the interlayer peeling is comparatively less likely to occur. From these viewpoints, it is preferable that the two hoop layers are not overlapped. It is preferable that a layer other than the hoop layer is interposed between the hoop layers. It is preferable that the straight layer and/or the bias layer are/is interposed between the hoop layers. That is, it is preferable that the interposition layer is present.

From the viewpoint of the strength, the laminated portion X is preferably located on an inner side with respect to the laminated portion Y in a range in which both the laminated portion X and the laminated portion Y are present. Also in the laminated constitution A (FIG. 2), the laminated portion X is located on the inner side with respect to the laminated portion Y.

From the viewpoint of the strength, the hoop layer in the laminated portion Y preferably has a thickness of 0.050 mm or greater and 0.090 mm or less.

From the viewpoint of the strength, at least a part of the laminated portion Y preferably constitutes the outermost layer of the shaft. In the laminated constitution A (FIG. 2), the whole laminated portion Y constitutes the outermost layer of the shaft. The constitution can contribute to the dispersion of the hoop layer. The dispersion is presumed to contribute to the increase in the strength.

Preferably, at least a part of the laminated portion X constitutes the innermost layer of the shaft. In the laminated constitution A (FIG. 2), a part of the laminated portion X constitutes the innermost layer of the shaft. In the laminated constitution A (FIG. 2), the laminated portion X constitutes the innermost layer of the shaft except for a range where the tip partial layer s1 is present. The constitution can contribute to the dispersion of the hoop layer. The dispersion is presumed to contribute to the increase in the strength.

The following Tables 1 and 2 show examples of prepregs capable of being used. These prepregs are commercially available.

TABLE 1

Examples of prepregs capable of being used

| | | | | | Physical property value of reinforcement fiber | | |
|---|---|---|---|---|---|---|---|
| Manufacturer | Trade name | Thickness of sheet (mm) | Fiber content (% by mass) | Resin content (% by mass) | Part number of fiber | Tensile Elastic Modulus (t/mm$^2$) | Tensile Strength (kgf/mm$^2$) |
| Toray Industries, Inc. | 3255S-10 | 0.082 | 76 | 24 | T700S | 24 | 500 |
| Toray Industries, Inc. | 3255S-12 | 0.103 | 76 | 24 | T700S | 24 | 500 |
| Toray Industries, Inc. | 3255S-15 | 0.123 | 76 | 24 | T700S | 24 | 500 |
| Toray Industries, Inc. | 2255S-10 | 0.082 | 76 | 24 | T800S | 30 | 600 |
| Toray Industries, Inc. | 2255S-12 | 0.102 | 76 | 24 | T800S | 30 | 600 |
| Toray Industries, Inc. | 2255S-15 | 0.123 | 76 | 24 | T800S | 30 | 600 |
| Toray Industries, Inc. | 2256S-10 | 0.077 | 80 | 20 | T800S | 30 | 600 |
| Toray Industries, Inc. | 2256S-12 | 0.103 | 80 | 20 | T800S | 30 | 600 |
| Toray Industries, Inc. | 2276S-10 | 0.077 | 80 | 20 | T800S | 30 | 600 |

TABLE 1-continued

| Examples of prepregs capable of being used | | | | | | | |
|---|---|---|---|---|---|---|---|
| | | | | | Physical property value of reinforcement fiber | | |
| Manufacturer | Trade name | Thickness of sheet (mm) | Fiber content (% by mass) | Resin content (% by mass) | Part number of fiber | Tensile Elastic Modulus ($t/mm^2$) | Tensile Strength ($kgf/mm^2$) |
| Toray Industries, Inc. | 805S-3 | 0.034 | 60 | 40 | M30S | 30 | 560 |
| Toray Industries, Inc. | 8053S-3 | 0.028 | 70 | 30 | M30S | 30 | 560 |
| Toray Industries, Inc. | 9255S-7A | 0.056 | 78 | 22 | M40S | 40 | 470 |
| Toray Industries, Inc. | 9255S-6A | 0.047 | 76 | 24 | M40S | 40 | 470 |
| Toray Industries, Inc. | 925AS-4C | 0.038 | 65 | 35 | M40S | 40 | 470 |
| Toray Industries, Inc. | 9053S-4 | 0.027 | 70 | 30 | M40S | 40 | 470 |
| Nippon Graphite Fiber Corporation | E1026A-09N | 0.100 | 63 | 37 | XN-10 | 10 | 190 |
| Nippon Graphite Fiber Corporation | E1026A-14N | 0.150 | 63 | 37 | XN-10 | 10 | 190 |

The tensile strength and the tensile elastic modulus are measured in accordance with "Testing Method for Carbon Fibers" JIS R7601:1986.

TABLE 2

| Examples of prepregs capable of being used | | | | | | | |
|---|---|---|---|---|---|---|---|
| | | | | | Physical property value of reinforcement fiber | | |
| Manufacturer | Trade name | Thickness of sheet (mm) | Fiber content (% by mass) | Resin content (% by mass) | Part number of fiber | Tensile Elastic Modulus ($t/mm^2$) | Tensile Strength ($kgf/mm^2$) |
| Mitsubishi Rayon Co., Ltd. | GE352H-160S | 0.150 | 65 | 35 | E glass | 7 | 320 |
| Mitsubishi Rayon Co., Ltd. | TR350C-100S | 0.083 | 75 | 25 | TR50S | 24 | 500 |
| Mitsubishi Rayon Co., Ltd. | TR350U-100S | 0.078 | 75 | 25 | TR50S | 24 | 500 |
| Mitsubishi Rayon Co., Ltd. | TR350C-125S | 0.104 | 75 | 25 | TR50S | 24 | 500 |
| Mitsubishi Rayon Co., Ltd. | TR350C-150S | 0.124 | 75 | 25 | TR50S | 24 | 500 |
| Mitsubishi Rayon Co., Ltd. | TR350C-175S | 0.147 | 75 | 25 | TR50S | 24 | 500 |
| Mitsubishi Rayon Co., Ltd. | MR350J-025S | 0.034 | 63 | 37 | MR40 | 30 | 450 |
| Mitsubishi Rayon Co., Ltd. | MR350J-050S | 0.058 | 63 | 37 | MR40 | 30 | 450 |
| Mitsubishi Rayon Co., Ltd. | MR350C-050S | 0.05 | 75 | 25 | MR40 | 30 | 450 |
| Mitsubishi Rayon Co., Ltd. | MR350C-075S | 0.063 | 75 | 25 | MR40 | 30 | 450 |
| Mitsubishi Rayon Co., Ltd. | MRX350C-075R | 0.063 | 75 | 25 | MR40 | 30 | 450 |
| Mitsubishi Rayon Co., Ltd. | MRX350C-100S | 0.085 | 75 | 25 | MR40 | 30 | 450 |
| Mitsubishi Rayon Co., Ltd. | MR350C-100S | 0.085 | 75 | 25 | MR40 | 30 | 450 |
| Mitsubishi Rayon Co., Ltd. | MRX350C-125S | 0.105 | 75 | 25 | MR40 | 30 | 450 |
| Mitsubishi Rayon Co., Ltd. | MR350C-125S | 0.105 | 75 | 25 | MR40 | 30 | 450 |

TABLE 2-continued

| Examples of prepregs capable of being used | | | | | | | |
|---|---|---|---|---|---|---|---|
| | | | | | Physical property value of reinforcement fiber | | |
| Manufacturer | Trade name | Thickness of sheet (mm) | Fiber content (% by mass) | Resin content (% by mass) | Part number of fiber | Tensile Elastic Modulus ($t/mm^2$) | Tensile Strength ($kgf/mm^2$) |
| Mitsubishi Rayon Co., Ltd. | MR350E-100S | 0.093 | 70 | 30 | MR40 | 30 | 450 |
| Mitsubishi Rayon Co., Ltd. | HRX350C-075S | 0.057 | 75 | 25 | HR40 | 40 | 450 |
| Mitsubishi Rayon Co., Ltd. | HRX350C-110S | 0.082 | 75 | 25 | HR40 | 40 | 450 |

The tensile strength and the tensile elastic modulus are measured in accordance with "Testing Method for Carbon Fibers" JIS R7601:1986.

EXAMPLES

Hereinafter, the effects of the present invention will be clarified by examples. However, the present invention should not be interpreted in a limited way based on the description of examples.

Table 3 shows the specifications of Example 1. A laminated constitution A (FIG. 2) is employed in Example 1. Table 4 shows the specifications of Example 2. A laminated constitution B (FIG. 3) is employed in Example 2. Table 5 shows the specifications of Example 3. The laminated constitution B (FIG. 3) is employed in Example 3. Table 6 shows the specifications of Example 4. The laminated constitution B (FIG. 3) is employed in Example 4. Table 7 shows the specifications of Example 5. A laminated constitution C (FIG. 4) is employed in Example 5. Table 8 shows the specifications of Example 6. The laminated constitution C (FIG. 4) is employed in Example 6. Table 9 shows the specifications of Example 7. The laminated constitution C (FIG. 4) is employed in Example 7. Table 10 shows the specifications of Example 8. A laminated constitution D (FIG. 5) is employed in Example 8. Table 11 shows the specifications of Example 9. A laminated constitution E (FIG. 6) is employed in Example 9. Table 12 shows the specifications of Example 10. A laminated constitution F (FIG. 7) is employed in Example 10. Table 13 shows the specifications of Comparative Example 1. The laminated constitution C (FIG. 4) is employed in Comparative Example 1. Table 14 shows the specifications of Comparative Example 2. The laminated constitution C (FIG. 4) is employed in Comparative Example 2. Table 15 shows the specifications of Comparative Example 3. The laminated constitution C (FIG. 4) is employed in Comparative Example 3. Table 16 shows the specifications of Comparative Example 4. In the laminated constitution of Comparative Example 4, a layer s8 in the laminated constitution A (FIG. 2) is divided into two layers. In each Table, CF means a carbon fiber, and GF means a glass fiber.

The specifications and evaluation results of Examples are shown in the following Tables 17 and 18. The specifications and evaluation results of Comparative Examples are shown in the following Table 19.

TABLE 3

| Specifications of Example 1 (Laminated Constitution A) | | | | | | | | | |
|---|---|---|---|---|---|---|---|---|---|
| Laminating order | Sheet (layer) | Fiber | Angle Af (degree) | Tensile elastic modulus of fiber ($t/mm^2$) | Prepreg thickness (mm) | Number of plies | Laminating thickness (mm) | P/t | T/t |
| 1 | s1 | GF | 0 | 7 | 0.150 | 1 | 0.150 | | |
| 2 | s2 | CF | −45 | 40 | 0.056 | 2 | 0.112 | | |
| 3 | s3 | CF | 90 | 30 | 0.063 | 1 | 0.063 | | |
| 4 | s4 | CF | +45 | 40 | 0.056 | 2 | 0.112 | 63 | 4.4 |
| 5 | s5 | CF | 0 | 24 | 0.083 | 1 | 0.083 | | |
| 6 | s6 | CF | 0 | 24 | 0.083 | 1 | 0.083 | | |
| 7 | s7 | CF | 0 | 24 | 0.083 | 1 | 0.083 | | |
| 8 | s8 | CF | 90 | 30 | 0.063 | 1 | 0.063 | | |
| 9 | s9 | CF | 0 | 24 | 0.124 | 1 | 0.124 | | |
| 10 | s10 | CF | 0 | 24 | 0.083 | 3 | 0.249 | | |
| Total | | | | | | | 1.122 | | |

TABLE 4

Specifications of Example 2 (Laminated Constitution B)

| Laminating order | Sheet (layer) | Fiber | Angle Af (degree) | Tensile elastic modulus of fiber (t/mm$^2$) | Prepreg thickness (mm) | Number of plies | Laminating thickness (mm) | P/t | T/t |
|---|---|---|---|---|---|---|---|---|---|
| 1 | s1 | GF | 0 | 7 | 0.150 | 1 | 0.15 | | |
| 2 | s2 | CF | −45 | 40 | 0.056 | 2 | 0.112 | | |
| 3 | s3 | CF | +45 | 40 | 0.056 | 2 | 0.112 | | |
| 4 | s4 | CF | 90 | 30 | 0.063 | 1 | 0.063 | | |
| 5 | s5 | CF | 0 | 24 | 0.083 | 1 | 0.083 | 32 | 2.6 |
| 6 | s6 | CF | 0 | 24 | 0.083 | 1 | 0.083 | | |
| 7 | s7 | CF | 0 | 24 | 0.083 | 1 | 0.083 | | |
| 8 | s8 | CF | 90 | 30 | 0.063 | 1 | 0.063 | | |
| 9 | s9 | CF | 0 | 24 | 0.124 | 1 | 0.124 | | |
| 10 | s10 | CF | 0 | 24 | 0.083 | 3 | 0.249 | | |
| Total | | | | | | | 1.122 | | |

TABLE 5

Specifications of Example 3 (Laminated Constitution B)

| Laminating order | Sheet (layer) | Fiber | Angle Af (degree) | Tensile elastic modulus of fiber (t/mm$^2$) | Prepreg thickness (mm) | Number of plies | Laminating thickness (mm) | P/t | T/t |
|---|---|---|---|---|---|---|---|---|---|
| 1 | s1 | GF | 0 | 7 | 0.150 | 1 | 0.15 | | |
| 2 | s2 | CF | −45 | 40 | 0.056 | 2 | 0.112 | | |
| 3 | s3 | CF | +45 | 40 | 0.056 | 2 | 0.112 | | |
| 4 | s4 | CF | 90 | 30 | 0.063 | 1 | 0.063 | | |
| 5 | s5 | CF | 0 | 24 | 0.083 | 1 | 0.083 | 32 | 2.3 |
| 6 | s6 | CF | 0 | 24 | 0.063 | 1 | 0.063 | | |
| 7 | s7 | CF | 0 | 24 | 0.083 | 1 | 0.083 | | |
| 8 | s8 | CF | 90 | 30 | 0.063 | 1 | 0.063 | | |
| 9 | s9 | CF | 0 | 24 | 0.147 | 1 | 0.147 | | |
| 10 | s10 | CF | 0 | 24 | 0.083 | 3 | 0.249 | | |
| Total | | | | | | | 1.125 | | |

TABLE 6

Specifications of Example 4 (Laminated Constitution B)

| Laminating order | Sheet (layer) | Fiber | Angle Af (degree) | Tensile elastic modulus of fiber (t/mm$^2$) | Prepreg thickness (mm) | Number of plies | Laminating thickness (mm) | P/t | T/t |
|---|---|---|---|---|---|---|---|---|---|
| 1 | s1 | GF | 0 | 7 | 0.150 | 1 | 0.15 | | |
| 2 | s2 | CF | −45 | 40 | 0.056 | 2 | 0.112 | | |
| 3 | s3 | CF | +45 | 40 | 0.056 | 2 | 0.112 | | |
| 4 | s4 | CF | 90 | 30 | 0.063 | 1 | 0.063 | | |
| 5 | s5 | CF | 0 | 24 | 0.083 | 1 | 0.083 | 32 | 2.0 |
| 6 | s6 | CF | 0 | 24 | 0.063 | 1 | 0.063 | | |
| 7 | s7 | CF | 0 | 24 | 0.063 | 1 | 0.063 | | |
| 8 | s8 | CF | 90 | 30 | 0.063 | 1 | 0.063 | | |
| 9 | s9 | CF | 0 | 24 | 0.083 | 2 | 0.166 | | |
| 10 | s10 | CF | 0 | 24 | 0.083 | 3 | 0.249 | | |
| Total | | | | | | | 1.124 | | |

TABLE 7

Specifications of Example 5 (Laminated Constitution C)

| Laminating order | Sheet (layer) | Fiber | Angle Af (degree) | Tensile elastic modulus of fiber (t/mm$^2$) | Prepreg thickness (mm) | Number of plies | Laminating thickness (mm) | P/t | T/t |
|---|---|---|---|---|---|---|---|---|---|
| 1 | s1 | GF | 0 | 7 | 0.150 | 1 | 0.15 | | |
| 2 | s2 | CF | −45 | 40 | 0.056 | 2 | 0.112 | | |
| 3 | s3 | CF | +45 | 40 | 0.056 | 2 | 0.112 | | |
| 4 | s4 | CF | 0 | 24 | 0.083 | 1 | 0.083 | | |
| 5 | s5 | CF | 0 | 24 | 0.063 | 1 | 0.063 | | |
| 6 | s6 | CF | 90 | 30 | 0.063 | 1 | 0.063 | | |
| 7 | s7 | CF | 0 | 24 | 0.124 | 1 | 0.124 | 16 | 2.0 |
| 8 | s8 | CF | 90 | 30 | 0.063 | 1 | 0.063 | | |
| 9 | s9 | CF | 0 | 24 | 0.104 | 1 | 0.104 | | |
| 10 | s10 | CF | 0 | 24 | 0.083 | 3 | 0.249 | | |
| Total | | | | | | | 1.123 | | |

TABLE 8

Specifications of Example 6 (Laminated Constitution C)

| Laminating order | Sheet (layer) | Fiber | Angle Af (degree) | Tensile elastic modulus of fiber (t/mm$^2$) | Prepreg thickness (mm) | Number of plies | Laminating thickness (mm) | P/t | T/t |
|---|---|---|---|---|---|---|---|---|---|
| 1 | s1 | GF | 0 | 7 | 0.150 | 1 | 0.15 | | |
| 2 | s2 | CF | −45 | 40 | 0.056 | 2 | 0.112 | | |
| 3 | s3 | CF | +45 | 40 | 0.056 | 2 | 0.112 | | |
| 4 | s4 | CF | 0 | 24 | 0.083 | 1 | 0.083 | | |
| 5 | s5 | CF | 0 | 24 | 0.063 | 1 | 0.063 | | |
| 6 | s6 | CF | 90 | 30 | 0.063 | 1 | 0.063 | | |
| 7 | s7 | CF | 0 | 24 | 0.147 | 1 | 0.147 | 16 | 2.3 |
| 8 | s8 | CF | 90 | 30 | 0.063 | 1 | 0.063 | | |
| 9 | s9 | CF | 0 | 24 | 0.083 | 1 | 0.083 | | |
| 10 | s10 | CF | 0 | 24 | 0.083 | 3 | 0.249 | | |
| Total | | | | | | | 1.125 | | |

TABLE 9

Specifications of Example 7 (Laminated Constitution C)

| Laminating order | Sheet (layer) | Fiber | Angle Af (degree) | Tensile elastic modulus of fiber (t/mm$^2$) | Prepreg thickness (mm) | Number of plies | Laminating thickness (mm) | P/t | T/t |
|---|---|---|---|---|---|---|---|---|---|
| 1 | s1 | GF | 0 | 7 | 0.150 | 1 | 0.15 | | |
| 2 | s2 | CF | −45 | 40 | 0.056 | 2 | 0.112 | | |
| 3 | s3 | CF | +45 | 40 | 0.056 | 2 | 0.112 | | |
| 4 | s4 | CF | 0 | 24 | 0.083 | 1 | 0.083 | | |
| 5 | s5 | CF | 0 | 24 | 0.063 | 1 | 0.063 | | |
| 6 | s6 | CF | 90 | 30 | 0.063 | 1 | 0.063 | | |
| 7 | s7 | CF | 0 | 24 | 0.063 | 2 | 0.126 | 32 | 2.0 |
| 8 | s8 | CF | 90 | 30 | 0.063 | 1 | 0.063 | | |
| 9 | s9 | CF | 0 | 24 | 0.104 | 1 | 0.104 | | |
| 10 | s10 | CF | 0 | 24 | 0.083 | 3 | 0.249 | | |
| Total | | | | | | | 1.125 | | |

TABLE 10

Specifications of Example 8 (Laminated Constitution D)

| Laminating order | Sheet (layer) | Fiber | Angle Af (degree) | Tensile elastic modulus of fiber (t/mm$^2$) | Prepreg thickness (mm) | Number of plies | Laminating thickness (mm) | P/t | T/t |
|---|---|---|---|---|---|---|---|---|---|
| 1 | s1 | GF | 0 | 7 | 0.150 | 1 | 0.150 | | |
| 2 | s2 | CF | −45 | 40 | 0.056 | 2 | 0.112 | | |
| 3 | s3 | CF | 90 | 30 | 0.063 | 1 | 0.063 | | |
| 4 | s4 | CF | +45 | 40 | 0.056 | 2 | 0.112 | 62 | 4.0 |
| 5 | s5 | CF | 0 | 24 | 0.083 | 1 | 0.083 | | |
| 6 | s6 | CF | 0 | 24 | 0.083 | 1 | 0.083 | | |
| 7 | s7 | CF | 90 | 30 | 0.034 | 1 | 0.034 | | |
| 8 | s8 | CF | 0 | 24 | 0.083 | 1 | 0.083 | 29 | 2.4 |
| 9 | s9 | CF | 90 | 30 | 0.034 | 1 | 0.034 | | |
| 10 | s10 | CF | 0 | 24 | 0.124 | 1 | 0.124 | | |
| 11 | s11 | CF | 0 | 24 | 0.083 | 3 | 0.249 | | |
| Total | | | | | | | 1.127 | | |

TABLE 11

Specifications of Example 9 (Laminated Constitution E)

| Laminating order | Sheet (layer) | Fiber | Angle Af (degree) | Tensile elastic modulus of fiber (t/mm$^2$) | Prepreg thickness (mm) | Number of plies | Laminating thickness (mm) | P/t | T/t |
|---|---|---|---|---|---|---|---|---|---|
| 1 | s1 | GF | 0 | 7 | 0.150 | 1 | 0.150 | | |
| 2 | s2 | CF | −45 | 40 | 0.056 | 2 | 0.112 | | |
| 3 | s3 | CF | 90 | 30 | 0.034 | 1 | 0.034 | | |
| 4 | s4 | CF | +45 | 40 | 0.056 | 2 | 0.112 | 59 | 3.3 |
| 5 | s5 | CF | 0 | 24 | 0.083 | 1 | 0.083 | | |
| 6 | s6 | CF | 90 | 30 | 0.034 | 1 | 0.034 | | |
| 7 | s7 | CF | 0 | 24 | 0.083 | 1 | 0.083 | 29 | 2.4 |
| 8 | s8 | CF | 90 | 30 | 0.034 | 1 | 0.034 | | |
| 9 | s9 | CF | 0 | 24 | 0.083 | 1 | 0.083 | 29 | 2.4 |
| 10 | s10 | CF | 90 | 30 | 0.034 | 1 | 0.034 | | |
| 11 | s11 | CF | 0 | 24 | 0.124 | 1 | 0.124 | | |
| 12 | s12 | CF | 0 | 24 | 0.083 | 3 | 0.249 | | |
| Total | | | | | | | 1.132 | | |

TABLE 12

Specifications of Example 10 (Laminated Constitution F)

| Laminating order | Sheet (layer) | Fiber | Angle Af (degree) | Tensile elastic modulus of fiber (t/mm$^2$) | Prepreg thickness (mm) | Number of plies | Laminating thickness (mm) | P/t | T/t |
|---|---|---|---|---|---|---|---|---|---|
| 1 | s1 | GF | 0 | 7 | 0.150 | 1 | 0.150 | | |
| 2 | s2 | CF | −45 | 40 | 0.056 | 2 | 0.112 | | |
| 3 | s3 | CF | 90 | 30 | 0.034 | 1 | 0.034 | | |
| 4 | s4 | CF | +45 | 40 | 0.056 | 2 | 0.112 | 59 | 3.3 |
| 5 | s5 | CF | 90 | 30 | 0.034 | 1 | 0.034 | | |
| 6 | s6 | CF | 0 | 24 | 0.083 | 1 | 0.083 | 41 | 3.4 |
| 7 | s7 | CF | 0 | 24 | 0.083 | 1 | 0.083 | | |
| 8 | s8 | CF | 0 | 24 | 0.083 | 1 | 0.083 | | |
| 9 | s9 | CF | 90 | 30 | 0.063 | 1 | 0.063 | | |
| 10 | s10 | CF | 0 | 24 | 0.124 | 1 | 0.124 | | |
| 11 | s11 | CF | 0 | 24 | 0.083 | 3 | 0.249 | | |
| Total | | | | | | | 1.127 | | |

TABLE 13

Specifications of Comparative Example 1 (Laminated Constitution C)

| Laminating order | Sheet (layer) | Fiber | Angle Af (degree) | Tensile elastic modulus of fiber (t/mm$^2$) | Prepreg thickness (mm) | Number of plies | Laminating thickness (mm) | P/t | T/t |
|---|---|---|---|---|---|---|---|---|---|
| 1 | s1 | GF | 0 | 7 | 0.150 | 1 | 0.15 | | |
| 2 | s2 | CF | −45 | 40 | 0.056 | 2 | 0.112 | | |
| 3 | s3 | CF | +45 | 40 | 0.056 | 2 | 0.112 | | |
| 4 | s4 | CF | 0 | 24 | 0.083 | 1 | 0.083 | | |
| 5 | s5 | CF | 0 | 24 | 0.104 | 1 | 0.104 | | |
| 6 | s6 | CF | 90 | 30 | 0.063 | 1 | 0.063 | | |
| 7 | s7 | CF | 0 | 24 | 0.063 | 1 | 0.063 | 16 | 1.0 |
| 8 | s8 | CF | 90 | 30 | 0.063 | 1 | 0.063 | | |
| 9 | s9 | CF | 0 | 24 | 0.124 | 1 | 0.124 | | |
| 10 | s10 | CF | 0 | 24 | 0.083 | 3 | 0.249 | | |
| Total | | | | | | | 1.123 | | |

TABLE 14

Specifications of Comparative Example 2 (Laminated Constitution C)

| Laminating order | Sheet (layer) | Fiber | Angle Af (degree) | Tensile elastic modulus of fiber (t/mm$^2$) | Prepreg thickness (mm) | Number of plies | Laminating thickness (mm) | P/t | T/t |
|---|---|---|---|---|---|---|---|---|---|
| 1 | s1 | GF | 0 | 7 | 0.150 | 1 | 0.15 | | |
| 2 | s2 | CF | −45 | 40 | 0.056 | 2 | 0.112 | | |
| 3 | s3 | CF | +45 | 40 | 0.056 | 2 | 0.112 | | |
| 4 | s4 | CF | 0 | 24 | 0.083 | 1 | 0.083 | | |
| 5 | s5 | CF | 0 | 24 | 0.083 | 1 | 0.083 | | |
| 6 | s6 | CF | 90 | 30 | 0.063 | 1 | 0.063 | | |
| 7 | s7 | CF | 0 | 24 | 0.083 | 1 | 0.083 | 16 | 1.3 |
| 8 | s8 | CF | 90 | 30 | 0.063 | 1 | 0.063 | | |
| 9 | s9 | CF | 0 | 24 | 0.124 | 1 | 0.124 | | |
| 10 | s10 | CF | 0 | 24 | 0.083 | 3 | 0.249 | | |
| Total | | | | | | | 1.122 | | |

TABLE 15

Specifications of Comparative Example 3 (Laminated Constitution C)

| Laminating order | Sheet (layer) | Fiber | Angle Af (degree) | Tensile elastic modulus of fiber (t/mm$^2$) | Prepreg thickness (mm) | Number of plies | Laminating thickness (mm) | P/t | T/t |
|---|---|---|---|---|---|---|---|---|---|
| 1 | s1 | GF | 0 | 7 | 0.150 | 1 | 0.15 | | |
| 2 | s2 | CF | −45 | 40 | 0.056 | 2 | 0.112 | | |
| 3 | s3 | CF | +45 | 40 | 0.056 | 2 | 0.112 | | |
| 4 | s4 | CF | 0 | 24 | 0.083 | 1 | 0.083 | | |
| 5 | s5 | CF | 0 | 24 | 0.063 | 1 | 0.063 | | |
| 6 | s6 | CF | 90 | 30 | 0.063 | 1 | 0.063 | | |
| 7 | s7 | CF | 0 | 24 | 0.104 | 1 | 0.104 | 16 | 1.7 |
| 8 | s8 | CF | 90 | 30 | 0.063 | 1 | 0.063 | | |
| 9 | s9 | CF | 0 | 24 | 0.124 | 1 | 0.124 | | |
| 10 | s10 | CF | 0 | 24 | 0.083 | 3 | 0.249 | | |
| Total | | | | | | | 1.123 | | |

TABLE 16

Specifications of Comparative Example 4 (Similar to Laminated Constitution A)

| Laminating order | Sheet (layer) | Fiber | Angle Af (degree) | Tensile elastic modulus of fiber (t/mm$^2$) | Prepreg thickness (mm) | Number of plies | Laminating thickness (mm) | P/t | T/t |
|---|---|---|---|---|---|---|---|---|---|
| 1 | s1 | GF | 0 | 7 | 0.150 | 1 | 0.150 | | |
| 2 | s2 | CF | −45 | 40 | 0.056 | 2 | 0.112 | | |
| 3 | s3 | CF | 90 | 30 | 0.063 | 1 | 0.063 | | |
| 4 | s4 | CF | +45 | 40 | 0.056 | 2 | 0.112 | 82 | 5.7 |
| 5 | s5 | CF | 0 | 24 | 0.083 | 1 | 0.083 | | |
| 6 | s6 | CF | 0 | 24 | 0.083 | 1 | 0.083 | | |
| 7 | s7 | CF | 0 | 24 | 0.083 | 1 | 0.083 | | |
| 8 | s8 | CF | 90 | 30 | 0.034 | 1 | 0.034 | | |
| 9 | s9 | CF | 90 | 30 | 0.034 | 1 | 0.034 | | |
| 10 | s10 | CF | 0 | 24 | 0.124 | 1 | 0.124 | | |
| 11 | s11 | CF | 0 | 24 | 0.083 | 3 | 0.249 | | |
| Total | | | | | | | 1.127 | | |

TABLE 17

Specifications and evaluation results of Examples

| | | Example 1 | Example 2 | Example 3 | Example 4 | Example 5 |
|---|---|---|---|---|---|---|
| | P/t | 63 | 32 | 32 | 32 | 16 |
| | T/t | 4.4 | 2.6 | 2.3 | 2.0 | 2.0 |
| Three-point flexural strength | Point T [kgf] | 250 | 245 | 240 | 235 | 229 |
| | Point B [kgf] | 75 | 70 | 67 | 64 | 60 |
| | Point C [kgf] | 110 | 105 | 100 | 95 | 90 |
| Result of ball-hitting test | Head speed [m/s] | 38.1 | 38.1 | 38.0 | 37.9 | 38.2 |
| | Launch angle [degree] | 15.2 | 15.2 | 15.1 | 15.0 | 15.3 |
| | Carry fall point [yds] | 165.0 | 164.5 | 163.5 | 162.4 | 165.5 |
| | Horizontal displacement of carry fall point [yds] | No displacement | Right 5.0 | Right 5.5 | Right 6.0 | Right 4.5 |

TABLE 18

Specifications and evaluation results of Examples

| | | Example 6 | Example 7 | Example 8 | Example 9 | Example 10 |
|---|---|---|---|---|---|---|
| | P/t | 16 | 32 | 46 | 39 | 50 |
| | T/t | 2.3 | 2.0 | 3.2 | 2.7 | 3.4 |
| Three-point flexural strength | Point T [kgf] | 233 | 235 | 236 | 236 | 244 |
| | Point B [kgf] | 63 | 64 | 65 | 65 | 69 |
| | Point C [kgf] | 94 | 95 | 103 | 88 | 103 |
| Result of ball-hitting test | Head speed [m/s] | 38.3 | 38.2 | 37.9 | 37.9 | 38.1 |
| | Launch angle [degree] | 15.4 | 15.3 | 15.0 | 15.1 | 15.2 |
| | Carry fall point [yds] | 166.6 | 165.5 | 162.9 | 163.0 | 165.0 |

TABLE 18-continued

| Specifications and evaluation results of Examples | | | | | | |
|---|---|---|---|---|---|---|
| | | Example 6 | Example 7 | Example 8 | Example 9 | Example 10 |
| | Horizontal displacement of carry fall point [yds] | Right 4.0 | Right 4.5 | Right 1.0 | Right 0.5 | No displacement |

TABLE 19

| Specifications and evaluation results of Comparative Examples | | | | | |
|---|---|---|---|---|---|
| | | Comparative Example 1 | Comparative Example 2 | Comparative Example 3 | Comparative Example 4 |
| | P/t | 16 | 16 | 16 | 41 |
| | T/t | 1.0 | 1.3 | 1.7 | 2.9 |
| Three-point flexural strength | Point T [kgf] | 215 | 220 | 225 | 228 |
| | Point B [kgf] | 51 | 54 | 57 | 59 |
| | Point C [kgf] | 80 | 83 | 87 | 89 |
| Result of ball-hitting test | Head speed [m/s] | 38.1 | 38.1 | 38.1 | 38.1 |
| | Launch angle [degree] | 15.2 | 15.2 | 15.2 | 15.2 |
| | Carry fall point [yds] | 164.5 | 164.5 | 164.5 | 165.0 |
| | Horizontal displacement of carry fall point [yds] | Right 5.0 | Right 5.0 | Right 5.0 | No displacement |

Example 1

A shaft of Example 1 was obtained in the same manner as in the manufacturing process of the shaft 6. A laminated constitution of Example 1 was a laminated constitution A shown in FIG. 2. The specifications of Example 1 are shown in the above Table 3. In Example 1, a reinforcement fiber of a sheet s1 was a glass fiber. In Table 3, the glass fiber is mentioned as "GF". A reinforcement fiber of the other sheets were a carbon fiber. In Table 3, the carbon fiber is mentioned as "CF". A shaft weight was 49 g.

The number of plies of each sheet is shown in Table 3 (laminated constitution A). Among them, the number of plies of a sheet s10 which is a tip partial sheet is the number of plies in a tip end Tp. This point is the same also in the other laminated constitutions.

Example 2

A laminated constitution B shown in FIG. 3 was employed. The specifications of Example 2 are shown in the above Table 4. A shaft of Example 2 was obtained in the same manner as in Example 1 except for the specifications shown in Table 4. A shaft weight was 49 g.

Example 3

A laminated constitution B (FIG. 3) was employed. The specifications of Example 3 are shown in the above Table 5. A shaft of Example 3 was obtained in the same manner as in Example 1 except for the specifications shown in Table 5. A shaft weight was 49 g.

Example 4

A laminated constitution B (FIG. 3) was employed. The specifications of Example 4 are shown in the above Table 6. A shaft of Example 4 was obtained in the same manner as in Example 1 except for the specifications shown in Table 6. A shaft weight was 49 g.

Example 5

A laminated constitution C (FIG. 4) was employed. The specifications of Example 5 are shown in the above Table 7. A shaft of Example 5 was obtained in the same manner as in Example 1 except for the specifications shown in Table 7. A shaft weight was 49 g.

Example 6

A laminated constitution C (FIG. 4) was employed. The specifications of Example 6 are shown in the above Table 8. A shaft of Example 6 was obtained in the same manner as in Example 1 except for the specifications shown in Table 8. A shaft weight was 49 g.

Example 7

A laminated constitution C (FIG. 4) was employed. The specifications of Example 7 are shown in the above Table 9. A shaft of Example 7 was obtained in the same manner as in Example 1 except for the specifications shown in Table 9. A shaft weight was 49 g.

Example 8

A laminated constitution D (FIG. 5) was employed. The specifications of Example 8 are shown in the above Table 10. A shaft of Example 8 was obtained in the same manner as in Example 1 except for the specifications shown in Table 10. A shaft weight was 49 g.

Example 9

A laminated constitution E (FIG. 6) was employed. The specifications of Example 9 are shown in the above Table 11. A shaft of Example 9 was obtained in the same manner as in Example 1 except for the specifications shown in Table 11. A shaft weight was 49 g.

Example 10

A laminated constitution F (FIG. 7) was employed. The specifications of Example 10 are shown in the above Table 12. A shaft of Example 10 was obtained in the same manner as in Example 1 except for the specifications shown in Table 12. A shaft weight was 49 g.

Comparative Example 1

A laminated constitution C (FIG. 4) was employed. The specifications of Comparative Example 1 are shown in the above Table 13. A shaft of Comparative Example 1 was obtained in the same manner as in Example 1 except for the specifications shown in Table 13. A shaft weight was 49 g.

Comparative Example 2

A laminated constitution C (FIG. 4) was employed. The specifications of Comparative Example 2 are shown in the above Table 14. A shaft of Comparative Example 2 was obtained in the same manner as in Example 1 except for the specifications shown in Table 14. A shaft weight was 49 g.

Comparative Example 3

A laminated constitution C (FIG. 4) was employed. The specifications of Comparative Example 3 are shown in the above Table 15. A shaft of Comparative Example 3 was obtained in the same manner as in Example 1 except for the specifications shown in Table 15. A shaft weight was 49 g.

Comparative Example 4

Comparative Example 4 was obtained in the same manner as in Example 1 except that a hoop layer s8 in a laminated constitution A (FIG. 2) was replaced by two thin layers. The specifications of Comparative Example 4 are shown in the above Table 16. A shaft weight was 49 g.

In Tables 3 to 16, a layer of which an angle Af is mentioned as 90 degrees is a hoop layer. For example, in Table 3 (Example 1), the hoop layer is a third layer s3 and an eighth layer s8. In Tables 3 to 16, a layer surrounded by a thick line is the hoop layer.

In Tables 3 to 16, the values of P/t and T/t are shown. For example, the calculation formulae of P/t and T/t in Table 3 are as follows.

$$P/t:(2+1+1)/0.063=63$$

$$T/t:(0.112+0.083+0.083)/0.063=4.4$$

As described above, when P/t is different in an axis direction, a minimum value is employed. Similarly, when T/t is different in the axis direction, a minimum value is employed. For example, the laminated constitution A of Example 1 (FIG. 2) includes a butt partial layer s5. The butt partial layer s5 is disregarded in the calculation of P/t and T/t (see Table 3).

For example, in Table 11 (Example 9), the number of "between the opposing hoop layers" is 3, and three P/t and three T/t are calculated. However, the average values of the three P/t and three T/t are employed as P/t and T/t of the shaft (see Table 17). Thus, when the number of "between the opposing hoop layers" is plural, the average value of P/t and the average value of T/t are employed.

When, between certain hoop layers, the thicknesses of the two hoop layers opposing each other are different from each other, the average value of the thicknesses of the hoop layers is a thickness t. For example, the number of "between the hoop layers" being present is 2 in Table 10 (Example 8), and the thicknesses of the hoop layers are different from each other in the inner interlayer (between the layer 3 and the layer 7). In this case, the average value of the thickness of the layer 3 and the thickness of the layer 7 is employed as the thickness t. The average value is (0.063+0.034)/2=0.0485. Therefore, P/t and T/t are calculated as follows between the hoop layers.

$$P/t:(2+1)/0.0485=62$$

$$T/t:(0.112+0.083)/0.0485=4.0$$

Here, the butt partial layer s5 is disregarded in the calculation of P/t and T/t.

In Comparative Example 4, the outer hoop layer s8 is replaced by two thin hoop layers 8 and 9 in the laminated constitution of Example 1. As shown in Table 16, in Comparative Example 4, no interposition layer is present between the layer 8 and the layer 9. Accordingly, P/t and T/t are zero between the layer 8 and the layer 9. Therefore, P/t and T/t as the average value are respectively 41 and 2.9 as shown in Table 19.

[Evaluation Method]

[Three-Point Flexural Strength]

Figure 8:
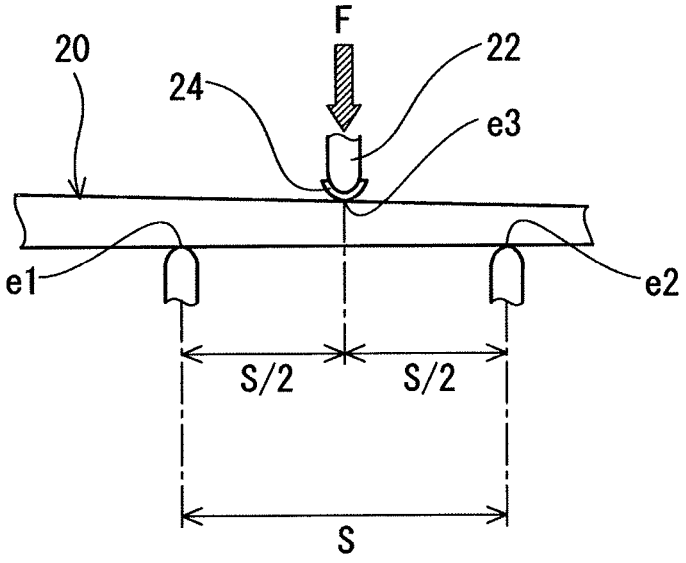
FIG. 8 describes a method for measuring three-point flexural strength.

Three-point flexural strength was measured based on an SG type three-point flexural strength test. This is a test set by Consumer Product Safety Association in Japan. FIG. 8 shows a measuring method of the three-point flexural strength test. A measured point e3 was set to a point T, a point B, and a point C. The point T is a point separated by 90 mm from a tip end Tp. The point B is a point separated by 525 mm from the tip end Tp. The point C is a point separated by 175 mm from a butt end Bt.

As shown in FIG. 8, a shaft 20 was supported from below at two supporting points e1 and e2. A silicone rubber 24 was attached to the tip of an indenter 22. The indenter 22 was moved downward from above at a load point e3. The descending speed of the indenter 22 was 20 mm/min. The load point e3 was at a position bisecting a distance between the supporting points e1 and e2. The load point e3 is the measured point. When the point T was measured, the span S was set to 150 mm. When the point B and the point C were measured, the span S was set to 300 mm. A value (peak value) of a load F when the shaft 20 was broken was measured. The values are shown in Tables 17 to 19.

[Ball-Hitting Test]

Five comparatively powerless testers hit balls using each of the shafts. The five testers had a handicap of 10 to 20. A head and a grip were attached to each of the shafts to obtain a test club. A head "XXIO EIGHT, loft 10.5 degrees" manufactured by Dunlop Sports Co., Ltd. was used as the head. A club length L1 was set to 45.5 inches. Each of the testers hit ten balls with each of the clubs. "XXIO XD AERO" manufactured by Dunlop Sports Co., Ltd. was used as the ball.

In the ball-hitting test, a head speed, a launch angle, a carry fall point, and horizontal displacement were measured. The horizontal displacement is a distance of displacement from a target direction. The horizontal displacement is horizontal displacement of the carry fall point. The average values of all shots are shown in the above Tables 17 to 19.

As shown in Tables 17 to 19, Examples have more excellent strength than that of Comparative Examples. The advantages of the present invention are apparent.

The shaft described above can be used for all golf clubs.

The description hereinabove is merely for an illustrative example, and various modifications can be made in the scope not to depart from the principles of the present invention.

What is claimed is:

1. A golf club shaft comprising:

at least two hoop layers;

at least one bias layer; and at least one straight layer, wherein:

an interposition layer other than the hoop layer is present between every opposing hoop layer;

if an average thickness of the opposing hoop layers is defined as t and a total thickness of the interposition layer is defined as T, the shaft satisfies the following formula (1):

$$T/t \geq 1.9 \quad (1); \text{ and}$$

if the total number of plies of the interposition layer is defined as P, the shaft satisfies the following formula (2):

$$P/t \geq 30 \quad (2).$$

2. The golf club shaft according to claim 1, wherein the hoop layer located on an outermost side in a radial direction has a thickness of 0.050 mm or greater and 0.090 mm or less.

3. The golf club shaft according to claim 1, wherein the shaft satisfies the following formula (3):

$$T/t \geq 2.2 \quad (3).$$

4. The golf club shaft according to claim 1, wherein the shaft satisfies the following formula (4):

$$T/t \geq 2.5 \quad (4).$$

5. A golf club shaft comprising:

at least two hoop layers;

at least one bias layer; and at least one straight layer, wherein:

an interposition layer other than the hoop layer is present between every opposing hoop layer;

if an average thickness of the opposing hoop layers is defined as t and a total thickness of the interposition layer is defined as T, the shaft satisfies the following formula (1):

$$T/t \geq 1.9 \quad (1);$$

the number of the straight layers is equal to or greater than 2;

the number of the bias layers is equal to or greater than 2;

a laminated portion X in which any one of the hoop layers is sandwiched between the two bias layers is present in at least a partial range in an axis direction of the shaft; and a laminated portion Y in which any one of the hoop layers is sandwiched between the two straight layers is present in at least a partial range in an axis direction of the shaft.

6. The golf club shaft according to claim 5, wherein the laminated portion X is located on an inner side with respect to the laminated portion Y in a range in which both the laminated portion X and the laminated portion Y are present.

7. The golf club shaft according to claim 5, wherein the hoop layer in the laminated portion Y has a thickness of 0.050 mm or greater and 0.090 mm or less.

8. The golf club shaft according to claim 5, wherein:

at least a part of the laminated portion Y constitutes an outermost layer of the shaft; and at least a part of the laminated portion X constitutes an innermost layer of the shaft.

* * * * *